US009260952B2

(12) United States Patent
Fripp et al.

(10) Patent No.: US 9,260,952 B2
(45) Date of Patent: Feb. 16, 2016

(54) METHOD AND APPARATUS FOR CONTROLLING FLUID FLOW IN AN AUTONOMOUS VALVE USING A STICKY SWITCH

(75) Inventors: Michael L Fripp, Carrollton, TX (US); Jason D. Dykstra, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/438,872

(22) Filed: Apr. 4, 2012

(65) Prior Publication Data

| | |
|---|---|
| US 2012/0255740 A1 | Oct. 11, 2012 |
| US 2014/0048280 A9 | Feb. 20, 2014 |
| US 2014/0284062 A9 | Sep. 25, 2014 |

Related U.S. Application Data

(63) Continuation-in-part of application No. 12/700,685, filed on Feb. 4, 2010, now Pat. No. 9,109,423, which is a continuation-in-part of application No. 12/542,695, filed on Aug. 18, 2009, now abandoned, application (Continued)

(51) Int. Cl.
*E21B 43/12* (2006.01)
*E21B 43/14* (2006.01)

(52) U.S. Cl.
CPC ..... *E21B 43/12* (2013.01); *E21B 43/14* (2013.01)

(58) Field of Classification Search
CPC ..... E21B 34/06; E21B 34/08; E21B 43/12; B04C 5/13; B04C 2003/006; B04C 5/04; B04C 5/081
USPC ..... 166/316, 319, 373, 386, 228, 205, 166/332.1; 137/808, 812, 804, 805, 810, 137/823, 837, 838, 825, 826
See application file for complete search history.

(56) References Cited

U.S. PATENT DOCUMENTS

| | | | |
|---|---|---|---|
| 553,727 | A | 1/1896 | Van Sickle |
| 1,329,559 | A | 2/1920 | Tesla |

(Continued)

FOREIGN PATENT DOCUMENTS

| | | | |
|---|---|---|---|
| EP | 0834342 | B1 | 1/1999 |
| EP | 1672167 | A1 | 6/2006 |

(Continued)

OTHER PUBLICATIONS

"Fluidics", Microsoft Encarta Online Encylopedia, copyright 1997-2009.

(Continued)

*Primary Examiner* — Blake Michener
*Assistant Examiner* — Wei Wang

(57) ABSTRACT

Apparatus and methods are described for autonomously controlling fluid flow in a tubular in a wellbore. A fluid is flowed through an inlet passageway into a biasing mechanism. A fluid flow distribution is established across the biasing mechanism. The fluid flow distribution is altered in response to a change in the fluid characteristic over time. In response, fluid flow through a downstream sticky switch assembly is altered, thereby altering fluid flow patterns in a downstream vortex assembly. The method "selects" based on a fluid characteristic, such as viscosity, density, velocity, flow rate, etc. The biasing mechanism can take various forms such as a widening passageway, contour elements along the biasing mechanism, or a curved section of the biasing mechanism passageway. The biasing mechanism can include hollows formed in the passageway wall, obstructions extending from the passageway wall, fluid diodes, Tesla fluid diodes, a chicane, or abrupt changes in passageway cross-section.

15 Claims, 13 Drawing Sheets

Related U.S. Application Data

No. 13/438,872, which is a continuation-in-part of application No. 12/791,993, filed on Jun. 2, 2010, now Pat. No. 8,235,128.

(60) Provisional application No. 61/473,669, filed on Apr. 8, 2011.

(56) References Cited

U.S. PATENT DOCUMENTS

| | | | |
|---|---|---|---|
| 2,140,735 | A | 12/1938 | Clarke |
| 2,324,819 | A | 6/1941 | Butzbach |
| 2,762,437 | A | 9/1956 | Egan |
| 2,849,070 | A | 8/1958 | Maly |
| 2,945,541 | A | 7/1960 | Maly |
| 2,981,332 | A | 4/1961 | Miller |
| 2,981,333 | A | 4/1961 | Miller |
| 3,091,393 | A | 5/1963 | Sparrow |
| 3,186,484 | A | 6/1965 | Waterman |
| 3,216,439 | A | 11/1965 | Manion |
| 3,233,621 | A | 2/1966 | Manion |
| 3,233,622 | A | 2/1966 | Boothe |
| 3,256,899 | A | 6/1966 | Dexter |
| 3,266,510 | A | 8/1966 | Wadey |
| 3,267,946 | A | 8/1966 | Adams |
| 3,282,279 | A | 11/1966 | Manion |
| 3,375,842 | A | 4/1968 | Reader |
| 3,427,580 | A | 2/1969 | Brock |
| 3,461,897 | A | 8/1969 | Kwok |
| 3,470,894 | A | 10/1969 | Rimmer |
| 3,474,670 | A | 10/1969 | Rupert |
| 3,477,506 | A | 11/1969 | Malone |
| 3,486,975 | A | 12/1969 | Ripley |
| 3,489,009 | A | 1/1970 | Rimmer |
| 3,515,160 | A | 6/1970 | Cohen |
| 3,521,657 | A | 7/1970 | Ayers |
| 3,529,614 | A | 9/1970 | Nelson |
| 3,537,466 | A | 11/1970 | Chapin |
| 3,554,209 | A | 1/1971 | Brown |
| 3,566,900 | A | 3/1971 | Black |
| 3,575,804 | A | 4/1971 | Ripley |
| 3,586,104 | A | 6/1971 | Hyde |
| 3,598,137 | A | 8/1971 | Glaze |
| 3,620,238 | A | 11/1971 | Kawahata |
| 3,638,672 | A | 2/1972 | Smith |
| 3,643,676 | A | 2/1972 | Limage |
| 3,670,753 | A | 6/1972 | Healey |
| 3,704,832 | A | 12/1972 | Fix |
| 3,712,321 | A | 1/1973 | Bauer |
| 3,717,164 | A | 2/1973 | Griffin |
| 3,730,673 | A | 5/1973 | Straitz |
| 3,745,115 | A | 7/1973 | Olsen |
| 3,754,576 | A | 8/1973 | Zetterstrom |
| 3,756,285 | A | 9/1973 | Johnson |
| 3,776,460 | A | 12/1973 | Fichter |
| 3,850,190 | A | 11/1974 | Carlson |
| 3,860,519 | A | 1/1975 | Weatherford |
| 3,876,016 | A | 4/1975 | Stinson |
| 3,885,627 | A | 5/1975 | Berry et al. |
| 3,895,901 | A | 7/1975 | Swartz |
| 3,927,849 | A | 12/1975 | Kovalenko |
| 3,942,557 | A | 3/1976 | Tsuchiya |
| 4,003,405 | A | 1/1977 | Hayes |
| 4,029,127 | A | 6/1977 | Thompson |
| 4,082,169 | A | 4/1978 | Bowles |
| 4,127,173 | A | 11/1978 | Watkins |
| 4,134,100 | A | 1/1979 | Funke |
| 4,138,669 | A | 2/1979 | Edison |
| 4,167,073 | A | 9/1979 | Tang |
| 4,167,873 | A | 9/1979 | Bahrton |
| 4,187,909 | A | 2/1980 | Erbstoesser |
| 4,268,245 | A | 5/1981 | Straitz, III |
| 4,276,943 | A | 7/1981 | Holmes |
| 4,279,304 | A | 7/1981 | Harper |
| 4,282,097 | A | 8/1981 | Kuepper |
| 4,286,627 | A | 9/1981 | Graf |
| 4,287,952 | A | 9/1981 | Erbstoesser |
| 4,291,395 | A | 9/1981 | Holmes |
| 4,303,128 | A | 12/1981 | Marr, Jr. |
| 4,307,204 | A | 12/1981 | Vidal |
| 4,307,653 | A | 12/1981 | Goes |
| 4,323,118 | A | 4/1982 | Bergmann |
| 4,323,991 | A | 4/1982 | Holmes |
| 4,345,650 | A | 8/1982 | Wesley |
| 4,364,232 | A | 12/1982 | Sheinbaum |
| 4,364,587 | A | 12/1982 | Samford |
| 4,385,875 | A | 5/1983 | Kanazawa |
| 4,390,062 | A | 6/1983 | Fox |
| 4,393,928 | A | 7/1983 | Warnock, Sr. |
| 4,396,062 | A | 8/1983 | Iskander |
| 4,418,721 | A | 12/1983 | Holmes |
| 4,442,903 | A | 4/1984 | Schutt |
| 4,467,833 | A | 8/1984 | Satterwhite |
| 4,485,780 | A | 12/1984 | Price |
| 4,491,186 | A | 1/1985 | Alder |
| 4,495,990 | A | 1/1985 | Titus |
| 4,518,013 | A | 5/1985 | Lazarus |
| 4,526,667 | A | 7/1985 | Parkhurst |
| 4,527,636 | A | 7/1985 | Bordon |
| 4,557,295 | A | 12/1985 | Holmes |
| 4,562,867 | A | 1/1986 | Stouffer |
| 4,570,675 | A | 2/1986 | Fenwick |
| 4,570,715 | A | 2/1986 | Van Meurs |
| 4,618,197 | A | 10/1986 | White |
| 4,648,455 | A | 3/1987 | Luke |
| 4,716,960 | A | 1/1988 | Eastlund |
| 4,747,451 | A | 5/1988 | Adams |
| 4,765,184 | A | 8/1988 | Delatore |
| 4,801,310 | A | 1/1989 | Bielefeldt |
| 4,805,407 | A | 2/1989 | Buchanan |
| 4,808,084 | A | 2/1989 | Tsubouchi |
| 4,817,863 | A | 4/1989 | Bragg |
| 4,846,224 | A | 7/1989 | Collins, Jr. |
| 4,848,991 | A | 7/1989 | Bielefeldt |
| 4,857,197 | A | 8/1989 | Young |
| 4,895,582 | A | 1/1990 | Bielefeldt |
| 4,911,239 | A | 3/1990 | Winckler |
| 4,919,201 | A | 4/1990 | Bridges |
| 4,919,204 | A | 4/1990 | Baker |
| 4,921,438 | A | 5/1990 | Godfrey |
| 4,945,995 | A | 8/1990 | Tholance |
| 4,967,048 | A | 10/1990 | Langston |
| 4,974,674 | A | 12/1990 | Wells |
| 4,984,594 | A | 1/1991 | Vinegar |
| 4,998,585 | A | 3/1991 | Newcomer |
| RE33,690 | E | 9/1991 | Adams, Jr. |
| 5,058,683 | A | 10/1991 | Godfrey |
| 5,076,327 | A | 12/1991 | Mettner |
| 5,080,783 | A | 1/1992 | Brown |
| 5,099,918 | A | 3/1992 | Bridges |
| 5,154,835 | A | 10/1992 | Demichael |
| 5,165,450 | A | 11/1992 | Marrelli |
| 5,166,677 | A | 11/1992 | Schoenberg |
| 5,184,678 | A | 2/1993 | Pechkov |
| 5,202,194 | A | 4/1993 | Vanberg |
| 5,207,273 | A | 5/1993 | Cates |
| 5,207,274 | A | 5/1993 | Streich |
| 5,228,508 | A | 7/1993 | Facteau |
| 5,251,703 | A | 10/1993 | Skinner |
| 5,279,363 | A | 1/1994 | Schultz |
| 5,282,508 | A | 2/1994 | Ellingsen |
| 5,303,782 | A | 4/1994 | Johannessen |
| 5,332,035 | A | 7/1994 | Schultz |
| 5,333,684 | A | 8/1994 | Walter |
| 5,337,808 | A | 8/1994 | Graham |
| 5,337,821 | A | 8/1994 | Peterson |
| 5,338,496 | A | 8/1994 | Talbot |
| 5,341,883 | A | 8/1994 | Ringgenberg |
| 5,343,963 | A | 9/1994 | Bouldin |
| 5,365,962 | A | 11/1994 | Taylor |
| 5,375,658 | A | 12/1994 | Schultz |
| 5,435,393 | A | 7/1995 | Brekke |
| 5,455,804 | A | 10/1995 | Holmes |
| 5,464,059 | A | 11/1995 | Kristiansen |

(56) References Cited

U.S. PATENT DOCUMENTS

| | | | |
|---|---|---|---|
| 5,482,117 | A | 1/1996 | Kolpak |
| 5,484,016 | A | 1/1996 | Surjaatmadja |
| 5,505,262 | A | 4/1996 | Cobb |
| 5,516,603 | A | 5/1996 | Holcombe |
| 5,533,571 | A | 7/1996 | Surjaatmadja |
| 5,547,029 | A | 8/1996 | Rubbo |
| 5,570,744 | A | 11/1996 | Weingarten |
| 5,578,209 | A | 11/1996 | Weiss |
| 5,673,751 | A | 10/1997 | Head |
| 5,707,214 | A | 1/1998 | Schmidt |
| 5,730,223 | A | 3/1998 | Restarick |
| 5,803,179 | A | 9/1998 | Echols |
| 5,815,370 | A | 9/1998 | Sutton |
| 5,839,508 | A | 11/1998 | Tubel |
| 5,868,201 | A | 2/1999 | Bussear |
| 5,893,383 | A | 4/1999 | Facteau |
| 5,896,076 | A | 4/1999 | Van Namen |
| 5,896,928 | A | 4/1999 | Coon |
| 6,009,951 | A | 1/2000 | Coronado |
| 6,015,011 | A | 1/2000 | Hunter |
| 6,032,733 | A | 3/2000 | Ludwig |
| 6,078,471 | A | 6/2000 | Fiske |
| 6,098,020 | A | 8/2000 | den Boer |
| 6,109,370 | A | 8/2000 | Gray |
| 6,109,372 | A | 8/2000 | Dorel et al. |
| 6,112,817 | A | 9/2000 | Voll |
| 6,164,375 | A | 12/2000 | Carisella |
| 6,176,308 | B1 | 1/2001 | Pearson |
| 6,179,052 | B1 | 1/2001 | Purkis |
| 6,199,399 | B1 | 3/2001 | Voorhis |
| 6,241,019 | B1 | 6/2001 | Davidson |
| 6,247,536 | B1 | 6/2001 | Leismer |
| 6,253,847 | B1 | 7/2001 | Stephenson |
| 6,253,861 | B1 | 7/2001 | Carmichael |
| 6,305,470 | B1 | 10/2001 | Woie |
| 6,315,043 | B1 | 11/2001 | Farrant |
| 6,315,049 | B1 | 11/2001 | Hickey |
| 6,320,238 | B1 | 11/2001 | Kawabata |
| 6,336,502 | B1 | 1/2002 | Surjaatmadja |
| 6,345,963 | B1 | 2/2002 | Thomin |
| 6,367,547 | B1 | 4/2002 | Towers |
| 6,371,210 | B1 | 4/2002 | Bode |
| 6,374,858 | B1 | 4/2002 | Hides |
| 6,397,950 | B1 | 6/2002 | Streich |
| 6,405,797 | B2 | 6/2002 | Davidson |
| 6,426,917 | B1 | 7/2002 | Tabanou |
| 6,431,282 | B1 | 8/2002 | Bosma |
| 6,433,991 | B1 | 8/2002 | Deaton |
| 6,450,263 | B1 | 9/2002 | Schwendemann |
| 6,464,011 | B2 | 10/2002 | Tubel |
| 6,470,970 | B1 | 10/2002 | Purkis |
| 6,497,252 | B1 | 12/2002 | Kohler |
| 6,505,682 | B2 | 1/2003 | Brockman |
| 6,516,888 | B1 | 2/2003 | Gunnarson |
| 6,540,263 | B1 | 4/2003 | Sausner |
| 6,544,691 | B1 | 4/2003 | Guidotti |
| 6,547,010 | B2 | 4/2003 | Hensley |
| 6,567,013 | B1 | 5/2003 | Purkis |
| 6,575,237 | B2 | 6/2003 | Purkis |
| 6,575,248 | B2 | 6/2003 | Zhang |
| 6,585,051 | B2 | 7/2003 | Purkis |
| 6,619,394 | B2 | 9/2003 | Soliman |
| 6,622,794 | B2 | 9/2003 | Zisk, Jr. |
| 6,627,081 | B1 | 9/2003 | Hilditch |
| 6,644,412 | B2 | 11/2003 | Bode |
| 6,668,936 | B2 | 12/2003 | Williamson, Jr. |
| 6,672,382 | B2 | 1/2004 | Schultz |
| 6,679,324 | B2 | 1/2004 | Den Boer |
| 6,679,332 | B2 | 1/2004 | Vinegar |
| 6,691,781 | B2 | 2/2004 | Grant |
| 6,695,067 | B2 | 2/2004 | Johnson |
| 6,705,085 | B1 | 3/2004 | Braithwaite |
| 6,708,763 | B2 | 3/2004 | Howard |
| 6,719,048 | B1 | 4/2004 | Ramos |
| 6,719,051 | B2 | 4/2004 | Hailey, Jr. |
| 6,725,925 | B2 | 4/2004 | Al-Ramadhan |
| 6,769,498 | B2 | 8/2004 | Hughes |
| 6,786,285 | B2 | 9/2004 | Johnson |
| 6,812,811 | B2 | 11/2004 | Robison |
| 6,817,416 | B2 | 11/2004 | Wilson |
| 6,834,725 | B2 | 12/2004 | Whanger |
| 6,840,325 | B2 | 1/2005 | Stephenson |
| 6,851,473 | B2 | 2/2005 | Davidson |
| 6,851,560 | B2 | 2/2005 | Reig |
| 6,857,475 | B2 | 2/2005 | Johnson |
| 6,857,476 | B2 | 2/2005 | Richards |
| 6,886,634 | B2 | 5/2005 | Richards |
| 6,907,937 | B2 | 6/2005 | Whanger |
| 6,913,079 | B2 | 7/2005 | Tubel |
| 6,935,432 | B2 | 8/2005 | Nguyen |
| 6,957,703 | B2 | 10/2005 | Trott |
| 6,958,704 | B2 | 10/2005 | Vinegar |
| 6,967,589 | B1 | 11/2005 | Peters |
| 6,976,507 | B1 | 12/2005 | Webb |
| 7,007,756 | B2 | 3/2006 | Lerche |
| 7,011,101 | B2 | 3/2006 | Bowe |
| 7,011,152 | B2 | 3/2006 | Soelvik |
| 7,013,979 | B2 | 3/2006 | Richard |
| 7,017,662 | B2 | 3/2006 | Schultz |
| 7,025,134 | B2 | 4/2006 | Byrd |
| 7,038,332 | B2 | 5/2006 | Robison |
| 7,040,391 | B2 | 5/2006 | Leuthen |
| 7,043,937 | B2 | 5/2006 | Lifson |
| 7,059,401 | B2 | 6/2006 | Bode |
| 7,063,162 | B2 | 6/2006 | Daling et al. |
| 7,066,261 | B2 | 6/2006 | Vicente |
| 7,096,945 | B2 | 8/2006 | Richards |
| 7,100,686 | B2 | 9/2006 | Wittrisch |
| 7,108,083 | B2 | 9/2006 | Simonds |
| 7,114,560 | B2 | 10/2006 | Nguyen |
| 7,143,832 | B2 | 12/2006 | Freyer |
| 7,168,494 | B2 | 1/2007 | Starr |
| 7,185,706 | B2 | 3/2007 | Freyer |
| 7,199,480 | B2 | 4/2007 | Fripp |
| 7,207,386 | B2 | 4/2007 | Brannon |
| 7,213,650 | B2 | 5/2007 | Lehman |
| 7,213,681 | B2 | 5/2007 | Birchak |
| 7,216,738 | B2 | 5/2007 | Birchak |
| 7,258,169 | B2 | 8/2007 | Fripp |
| 7,290,606 | B2 | 11/2007 | Coronado |
| 7,318,471 | B2 | 1/2008 | Rodney |
| 7,322,409 | B2 | 1/2008 | Wittle |
| 7,322,416 | B2 | 1/2008 | Burris |
| 7,350,577 | B2 | 4/2008 | Howard |
| 7,363,967 | B2 | 4/2008 | Burris |
| 7,404,416 | B2 | 7/2008 | Schultz |
| 7,405,998 | B2 | 7/2008 | Webb |
| 7,409,999 | B2 | 8/2008 | Henriksen |
| 7,413,010 | B2 | 8/2008 | Blauch |
| 7,419,002 | B2 | 9/2008 | Dybevik et al. |
| 7,426,962 | B2 | 9/2008 | Moen |
| 7,440,283 | B1 | 10/2008 | Rafie |
| 7,455,104 | B2 | 11/2008 | Duhon |
| 7,464,609 | B2 | 12/2008 | Fallet |
| 7,468,890 | B2 | 12/2008 | Lin |
| 7,469,743 | B2 | 12/2008 | Richards |
| 7,520,321 | B2 | 4/2009 | Hiron |
| 7,537,056 | B2 | 5/2009 | Macdougall |
| 7,578,343 | B2 | 8/2009 | Augustine |
| 7,621,336 | B2 | 11/2009 | Badalamenti |
| 7,644,773 | B2 | 1/2010 | Richard |
| 7,686,078 | B2 | 3/2010 | Khomynets |
| 7,699,102 | B2 | 4/2010 | Storm |
| 7,708,068 | B2 | 5/2010 | Hailey, Jr. |
| 7,780,152 | B2 | 8/2010 | Rao |
| 7,814,973 | B2 | 10/2010 | Dusterhoft |
| 7,828,067 | B2 | 11/2010 | Scott |
| 7,857,050 | B2 | 12/2010 | Zazovsky |
| 7,882,894 | B2 | 2/2011 | Nguyen |
| 7,918,272 | B2 | 4/2011 | Gaudette |
| 8,016,030 | B1 | 9/2011 | Prado Garcia |
| 8,025,103 | B1 | 9/2011 | Wolinsky |
| 8,083,935 | B2 | 12/2011 | Eia |
| 8,127,856 | B1 | 3/2012 | Nish |

(56) References Cited

U.S. PATENT DOCUMENTS

| | | | |
|---|---|---|---|
| 8,191,627 | B2 | 6/2012 | Hamid |
| 8,196,665 | B2 | 6/2012 | Wolinsky |
| 8,235,128 | B2 | 8/2012 | Dykstra |
| 8,261,839 | B2 | 9/2012 | Fripp |
| 8,272,443 | B2 | 9/2012 | Watson |
| 8,276,669 | B2 | 10/2012 | Dykstra |
| 8,302,696 | B2 | 11/2012 | Williams et al. |
| 2002/0148607 | A1 | 10/2002 | Pabst |
| 2002/0150483 | A1 | 10/2002 | Ursan |
| 2003/0173086 | A1 | 9/2003 | Howard |
| 2004/0011561 | A1 | 1/2004 | Hughes |
| 2005/0110217 | A1 | 5/2005 | Wood |
| 2005/0150657 | A1 | 7/2005 | Howard |
| 2005/0173351 | A1 | 8/2005 | Neofotistos |
| 2005/0214147 | A1 | 9/2005 | Schultz |
| 2006/0076150 | A1 | 4/2006 | Coronado |
| 2006/0113089 | A1 | 6/2006 | Henriksen |
| 2006/0131033 | A1 | 6/2006 | Bode |
| 2006/0185849 | A1 | 8/2006 | Edwards |
| 2007/0012454 | A1 | 1/2007 | Ross |
| 2007/0028977 | A1 | 2/2007 | Goulet |
| 2007/0045038 | A1 | 3/2007 | Han |
| 2007/0107719 | A1 | 5/2007 | Blacker |
| 2007/0169942 | A1 | 7/2007 | Loretz |
| 2007/0173397 | A1 | 7/2007 | Hinman |
| 2007/0193752 | A1 | 8/2007 | Kim |
| 2007/0246225 | A1 | 10/2007 | Hailey |
| 2007/0246407 | A1 | 10/2007 | Richards |
| 2007/0256828 | A1 | 11/2007 | Birchak |
| 2008/0035330 | A1 | 2/2008 | Richards |
| 2008/0041580 | A1 | 2/2008 | Freyer |
| 2008/0041581 | A1 | 2/2008 | Richards |
| 2008/0041582 | A1 | 2/2008 | Saetre |
| 2008/0041588 | A1 | 2/2008 | Richards |
| 2008/0149323 | A1 | 6/2008 | Omalley |
| 2008/0169099 | A1 | 7/2008 | Pensgaard |
| 2008/0236839 | A1 | 10/2008 | Oddie |
| 2008/0251255 | A1 | 10/2008 | Forbes |
| 2008/0261295 | A1 | 10/2008 | Butler |
| 2008/0283238 | A1 | 11/2008 | Richards |
| 2008/0314578 | A1 | 12/2008 | Jackson |
| 2008/0314590 | A1 | 12/2008 | Patel |
| 2009/0000787 | A1 | 1/2009 | Hill |
| 2009/0008088 | A1 | 1/2009 | Schultz |
| 2009/0008090 | A1 | 1/2009 | Schultz |
| 2009/0009297 | A1 | 1/2009 | Shinohara |
| 2009/0009333 | A1 | 1/2009 | Bhogal |
| 2009/0009336 | A1 | 1/2009 | Ishikawa |
| 2009/0009412 | A1 | 1/2009 | Warther |
| 2009/0009437 | A1 | 1/2009 | Hwang |
| 2009/0009445 | A1 | 1/2009 | Lee |
| 2009/0009447 | A1 | 1/2009 | Naka |
| 2009/0020292 | A1 | 1/2009 | Loretz |
| 2009/0065197 | A1 | 3/2009 | Eslinger |
| 2009/0078427 | A1 | 3/2009 | Patel |
| 2009/0078428 | A1 | 3/2009 | Ali |
| 2009/0101342 | A1 | 4/2009 | Gaudette |
| 2009/0101344 | A1 | 4/2009 | Crow |
| 2009/0101352 | A1 | 4/2009 | Coronado |
| 2009/0101354 | A1 | 4/2009 | Holmes |
| 2009/0114395 | A1 | 5/2009 | Holmes |
| 2009/0120647 | A1 | 5/2009 | Turick |
| 2009/0133869 | A1 | 5/2009 | Clem |
| 2009/0151925 | A1 | 6/2009 | Richards |
| 2009/0159282 | A1 | 6/2009 | Webb |
| 2009/0188661 | A1 | 7/2009 | Bizon |
| 2009/0205834 | A1 | 8/2009 | Garcia et al. |
| 2009/0226301 | A1 | 9/2009 | Priestman |
| 2009/0250224 | A1 | 10/2009 | Wright |
| 2009/0277639 | A1 | 11/2009 | Schultz |
| 2009/0277650 | A1 | 11/2009 | Casciaro |
| 2009/0301730 | A1 | 12/2009 | Gweily |
| 2010/0025045 | A1 | 2/2010 | Lake |
| 2010/0122804 | A1 | 5/2010 | Yang |
| 2010/0181251 | A1 | 7/2010 | Alspektor |
| 2010/0249723 | A1 | 9/2010 | Fangrow, Jr. |
| 2010/0300568 | A1 | 12/2010 | Faram |
| 2011/0017458 | A1 | 1/2011 | East |
| 2011/0042091 | A1* | 2/2011 | Dykstra et al. ..... 166/316 |
| 2011/0042092 | A1 | 2/2011 | Fripp |
| 2011/0042323 | A1 | 2/2011 | Sullivan |
| 2011/0079384 | A1 | 4/2011 | Russell |
| 2011/0139451 | A1 | 6/2011 | McKeen |
| 2011/0139453 | A1 | 6/2011 | Schultz |
| 2011/0186300 | A1 | 8/2011 | Dykstra |
| 2011/0198097 | A1 | 8/2011 | Moen |
| 2011/0203671 | A1 | 8/2011 | Doig |
| 2011/0214876 | A1 | 9/2011 | Dykstra |
| 2011/0266001 | A1 | 11/2011 | Dykstra |
| 2011/0297384 | A1 | 12/2011 | Fripp |
| 2011/0297385 | A1 | 12/2011 | Dykstra |
| 2012/0048563 | A1 | 3/2012 | Holderman |
| 2012/0060624 | A1 | 3/2012 | Dykstra |
| 2012/0061088 | A1 | 3/2012 | Dykstra |
| 2012/0111577 | A1 | 5/2012 | Dykstra |
| 2012/0125120 | A1 | 5/2012 | Dykstra |
| 2012/0125626 | A1 | 5/2012 | Constantine |
| 2012/0138304 | A1 | 6/2012 | Dykstra |
| 2012/0145385 | A1 | 6/2012 | Lopez |
| 2012/0152527 | A1 | 6/2012 | Dykstra |
| 2012/0181037 | A1 | 7/2012 | Holderman |
| 2012/0211243 | A1 | 8/2012 | Dykstra |
| 2012/0234557 | A1 | 9/2012 | Dykstra |
| 2012/0255351 | A1 | 10/2012 | Dykstra |
| 2012/0255739 | A1 | 10/2012 | Fripp |
| 2012/0255740 | A1 | 10/2012 | Fripp |
| 2012/0305243 | A1 | 12/2012 | Hallundbaek |
| 2013/0020088 | A1 | 1/2013 | Dyer |
| 2013/0075107 | A1 | 3/2013 | Dykstra |

FOREIGN PATENT DOCUMENTS

| | | | |
|---|---|---|---|
| EP | 1857633 | | 11/2007 |
| EP | 1857633 | A2 | 11/2007 |
| WO | 0063530 | A1 | 10/2000 |
| WO | 0214647 | A2 | 2/2002 |
| WO | 03062597 | A1 | 7/2003 |
| WO | 2004012040 | A2 | 2/2004 |
| WO | 2004081335 | A2 | 9/2004 |
| WO | 2006015277 | A1 | 2/2006 |
| WO | 2008024645 | A2 | 2/2008 |
| WO | 2009081088 | A2 | 2/2009 |
| WO | 2009052076 | A2 | 4/2009 |
| WO | 2009052103 | A2 | 4/2009 |
| WO | 2009052149 | | 4/2009 |
| WO | 2009088292 | A1 | 7/2009 |
| WO | 2009088293 | A1 | 7/2009 |
| WO | 2009088624 | A2 | 7/2009 |

OTHER PUBLICATIONS

Kirshner et al., "Design Theory of Fluidic Components", 1975, Academic Press, New York.

Kirshner, "Fluid Amplifiers", 1966, McGraw-Hill, New York.

Tesar, "New Ways of Fluid Flow Control in Automobiles: Experience with Exhaust Gas Aftertreatment Control", Seoul 2000 FISITA World Automotive Congress, Jun. 12-15, 2000, F2000H192.

Tesar, "Sampling by Fluidics and Microfluidics", Acta Polytechnica vol. 42 No. 2/2002, Jun. 24, 2005.

Angrist, "Fluid Control Device", Scientific American Dec. 1964, pp. 80-88, Dec. 1, 1964.

Freyer, "An Oil Selective Inflow Control System", SPE 78272, Oct. 2002.

"Apparatus and Method of Inducting Fluidic Oscillation in a Rotating Cleaning Nozzle," ip.com, dated Apr. 24, 2007, 3 pages.

Stephen L. Crow, Martin P. Coronado, Rustom K. Mody, "Means for Passive Inflow Control Upon Gas Breakthrough," SPE 102208, 2006 SPE Annual Technical Conference and Exhibition, San Antonio, Texas, U.S.A., Sep. 24-27, 2006, 6 pages.

Gebben, Vernon D., "Vortex Valve Performance Power Index," NASA TM X-52257, May 1967, pp. 1-14 plus 2 cover pages and Figures 1-8, National Aeronautics and Space Administration.

(56) References Cited

OTHER PUBLICATIONS

Haakh, Dr.-Ing. Frieder, "Vortex Chamber Diodes as Throttle Devices in Pipe Systems. Computation of Transient Flow," Journal of Hydraulic Research, 2003, vol. 41, No. 1, pp. 53-59.
Holmes, Allen B., et al., "A fluidic approach to the design of a mud pulser for bore-hole telemetry while drilling," DRCMS Code: 7-36AA-7100, HDL Project: A54735, Aug. 1979, pp. 1,2,5,6,9-27, and 29-37, Department of the Interior, U.S. Geological Survey, Washington, D.C.
Lee Precision Micro Hydraulics, Lee Restrictor Selector product brochure; Jan. 2011, 9 pages.
The Lee Company Technical Center, "Technical Hydraulic Handbook," 11th Edition, copyright 1971-2009, 7 pages Connecticut.
Weatherford product brochure entitled, "Application Answers—Combating Coning by Creating Even Flow Distribution in Horizontal Sand-Control Completions," 2005, 4 pages, Weatherford.
J.D Willingham, H.C. Tan, L.R. Norman, "Perforation Friction Pressure of Fracturing Fluid Slurries," SPE 25891, SPE Rocky Mountain Regional/Low Permeability Reservoirs Symposium, Denver, Co., U.S.A., Apr. 12-14, 1993, 14 pages.
Masahiro Takebayashi, Hiroshi Iwata, Akio Sakazume, Hiroaki Hata, "Discharge Characteristics of an Oil Feeder Pump Using Nozzle Type Fluidic Diodes for a Horizontal Compressor Depending on the Driving Speed," International Compressor Engineering Conference, Paper 597, 1988, 9 pages.
International Search Report and Written Opinion, PCT/US2012/032044, Mail Date Oct. 25, 2012, 9 pages.
Canadian Office Action, Application No. 2,737,998, Mail Date Jun. 21, 2013, 3 pages.
Flossert "Constant Flow Rate Product Brochure", Dec. 2002, 1 page.
Savkar, An Experimental Study of Switching in a Bistable Fluid Amplifier, University of Michigan, Dec. 1966.

* cited by examiner

METHOD AND APPARATUS FOR CONTROLLING FLUID FLOW IN AN AUTONOMOUS VALVE USING A STICKY SWITCH

CROSS-REFERENCE TO RELATED APPLICATIONS

This application is a Continuation in Part of application Ser. No. 12/700,685, filed Feb. 4, 2010, which is a Continuation in Part of application Ser. No. 12/542,695, filed Aug. 18, 2009, now abandoned, and claims priority to U.S. provisional application Ser. No. 61/473,669, filed Apr. 8, 2011, which is incorporated herein by reference for all purposes. This application is also a Continuation-in-part of application Ser. No. 12/791,993, filed Jun. 2, 2010, now issued as U.S. Pat. No. 8,235,128.

FIELD OF INVENTION

The invention relates generally to methods and apparatus of control of an autonomous fluid valve using a "sticky switch" or biasing mechanism to control fluid flow, and more specifically to use of such mechanisms to control fluid flow between a hydrocarbon bearing subterranean formation and a tool string in a wellbore.

BACKGROUND OF INVENTION

During the completion of a well that traverses a hydrocarbon bearing subterranean formation, production tubing and various equipment are installed in the well to enable safe and efficient production of the fluids. For example, to prevent the production of particulate material from an unconsolidated or loosely consolidated subterranean formation, certain completions include one or more sand control screens positioned proximate the desired production intervals. In other completions, to control the flow rate of production fluids into the production tubing, it is common practice to install one or more inflow control devices with the completion string.

Production from any given production tubing section can often have multiple fluid components, such as natural gas, oil and water, with the production fluid changing in proportional composition over time. Thereby, as the proportion of fluid components changes, the fluid flow characteristics will likewise change. For example, when the production fluid has a proportionately higher amount of natural gas, the viscosity of the fluid will be lower and density of the fluid will be lower than when the fluid has a proportionately higher amount of oil. It is often desirable to reduce or prevent the production of one constituent in favor of another. For example, in an oil-producing well, it may be desired to reduce or eliminate natural gas production and to maximize oil production. While various downhole tools have been utilized for controlling the flow of fluids based on their desirability, a need has arisen for a flow control system for controlling the inflow of fluids that is reliable in a variety of flow conditions. Further, a need has arisen for a flow control system that operates autonomously, that is, in response to changing conditions downhole and without requiring signals from the surface by the operator. Further, a need has arisen for a flow control system without moving mechanical parts which are subject to breakdown in adverse well conditions including from the erosive or clogging effects of sand in the fluid. Similar issues arise with regard to injection situations, with flow of fluids going into instead of out of the formation.

SUMMARY OF THE INVENTION

An apparatus and method are described for autonomously controlling flow of fluid in a tubular positioned in a wellbore extending through a hydrocarbon-bearing subterranean formation. In a method, a fluid is through an inlet passageway into a biasing mechanism. A first fluid flow distribution is established across the outlet of the flow biasing mechanism. The fluid flow is altered to a second flow distribution across the outlet of the flow biasing mechanism in response to a change in the fluid characteristic over time. In response, the fluid flow through a downstream sticky switch assembly is altered, thereby altering fluid flow patterns in a downstream vortex assembly. The fluid flow through the vortex assembly "selects" for fluid of a preferred characteristic, such as more or less viscous, dense, of greater or lesser velocity, etc., by inducing more or less spiraled flow through the vortex.

The biasing mechanism can take various embodiments. The biasing mechanism can include a widening of the fluid passageway, preferably from narrower at the upstream end and to wider at the downstream end. Alternately, the biasing mechanism can include at least one contour element along at least one side of the biasing mechanism. The contour elements can be hollows formed in the passageway wall or obstructions extending from the passageway wall. The biasing mechanism can include fluid diodes, Tesla fluid diodes, a chicane, an abrupt change in passageway cross-section, or a curved section of passageway.

The downhole tubular can include a plurality of flow control systems. The flow control systems can be used in production and injection methods. The flow control systems autonomously select for fluid of a desired characteristic as that characteristic changes over time.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the Specification will state or make such clear. Uphole and downhole are used to indicate relative location or direction in relation to the surface, where upstream indicates relative position or movement towards the surface along the wellbore and downstream indicates relative position or movement further away from the surface along the wellbore, regardless of whether in a horizontal, deviated or vertical wellbore. The terms upstream and downstream are used to indicate relative position or movement of fluid in relation to the direction of fluid flow.

DETAILED DESCRIPTION OF PREFERRED EMBODIMENTS

While the making and using of various embodiments of the present invention are discussed in detail below, a practitioner of the art will appreciate that the present invention provides applicable inventive concepts which can be embodied in a variety of specific contexts. The specific embodiments discussed herein are illustrative of specific ways to make and use the invention and do not limit the scope of the present invention.

Figure 1:
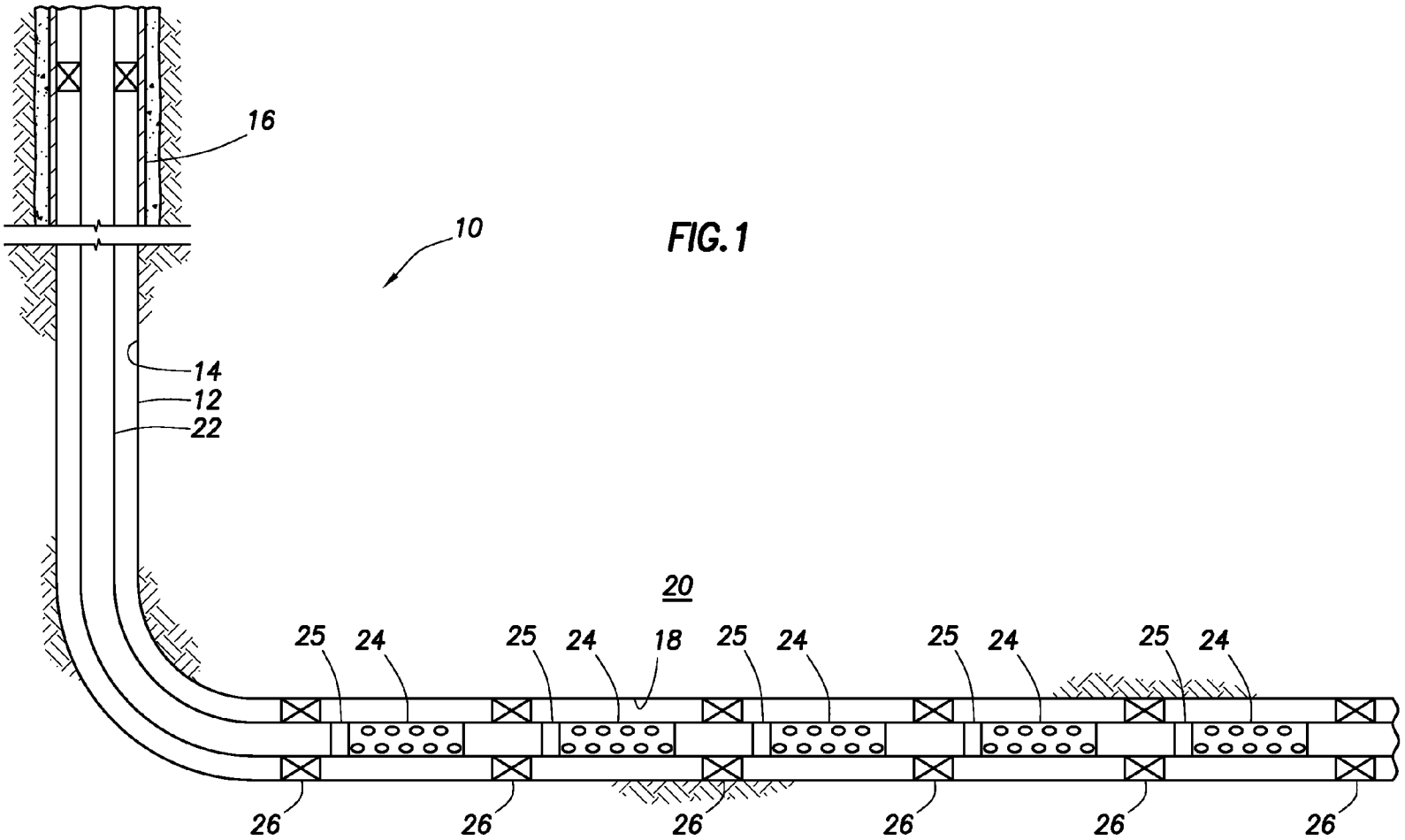
FIG. 1 is a schematic illustration of a well system including a plurality of autonomous flow control systems embodying principles of the present invention.

FIG. 1 is a schematic illustration of a well system, indicated generally 10, including a plurality of autonomous flow control systems embodying principles of the present invention. A wellbore 12 extends through various earth strata. Wellbore 12 has a substantially vertical section 14, the upper portion of which has installed therein a casing string 16. Wellbore 12 also has a substantially deviated section 18, shown as horizontal, which extends through a hydrocarbon-bearing subterranean formation 20. As illustrated, substantially horizontal section 18 of wellbore 12 is open hole. While shown here in an open hole, horizontal section of a wellbore, the invention will work in any orientation, and in open or cased hole. The invention will also work equally well with injection systems, as will be discussed supra.

Positioned within wellbore 12 and extending from the surface is a tubing string 22. Tubing string 22 provides a conduit for fluids to travel from formation 20 upstream to the surface. Positioned within tubing string 22 in the various production intervals adjacent to formation 20 are a plurality of autonomous flow control systems 25 and a plurality of production tubing sections 24. At either end of each production tubing section 24 is a packer 26 that provides a fluid seal between tubing string 22 and the wall of wellbore 12. The space in-between each pair of adjacent packers 26 defines a production interval.

In the illustrated embodiment, each of the production tubing sections 24 includes sand control capability. Sand control screen elements or filter media associated with production tubing sections 24 are designed to allow fluids to flow therethrough but prevent particulate matter of sufficient size from flowing therethrough. While the invention does not need to have a sand control screen associated with it, if one is used, then the exact design of the screen element associated with fluid flow control systems is not critical to the present invention. There are many designs for sand control screens that are well known in the industry, and will not be discussed here in detail. Also, a protective outer shroud having a plurality of perforations therethrough may be positioned around the exterior of any such filter medium.

Through use of the flow control systems 25 of the present invention in one or more production intervals, some control over the volume and composition of the produced fluids is enabled. For example, in an oil production operation if an undesired fluid component, such as water, steam, carbon dioxide, or natural gas, is entering one of the production intervals, the flow control system in that interval will autonomously restrict or resist production of fluid from that interval.

The term "natural gas" as used herein means a mixture of hydrocarbons (and varying quantities of non-hydrocarbons) that exist in a gaseous phase at room temperature and pressure. The term does not indicate that the natural gas is in a gaseous phase at the downhole location of the inventive systems. Indeed, it is to be understood that the flow control system is for use in locations where the pressure and temperature are such that natural gas will be in a mostly liquefied state, though other components may be present and some components may be in a gaseous state. The inventive concept will work with liquids or gases or when both are present.

The fluid flowing into the production tubing section 24 typically comprises more than one fluid component. Typical components are natural gas, oil, water, steam or carbon dioxide. Steam and carbon dioxide are commonly used as injection fluids to drive the hydrocarbon towards the production tubular, whereas natural gas, oil and water are typically found in situ in the formation. The proportion of these components in the fluid flowing into each production tubing section 24 will vary over time and based on conditions within the formation and wellbore. Likewise, the composition of the fluid flowing into the various production tubing sections throughout the length of the entire production string can vary significantly from section to section. The flow control system is designed to reduce or restrict production from any particular interval when it has a higher proportion of an undesired component.

Accordingly, when a production interval corresponding to a particular one of the flow control systems produces a greater proportion of an undesired fluid component, the flow control system in that interval will restrict or resist production flow from that interval. Thus, the other production intervals which are producing a greater proportion of desired fluid component, in this case oil, will contribute more to the production stream entering tubing string 22. In particular, the flow rate from formation 20 to tubing string 22 will be less where the fluid must flow through a flow control system (rather than simply flowing into the tubing string). Stated another way, the flow control system creates a flow restriction on the fluid.

Though FIG. 1 depicts one flow control system in each production interval, it should be understood that any number of systems of the present invention can be deployed within a production interval without departing from the principles of the present invention. Likewise, the inventive flow control systems do not have to be associated with every production interval. They may only be present in some of the production intervals in the wellbore or may be in the tubing passageway to address multiple production intervals.

Figure 2:
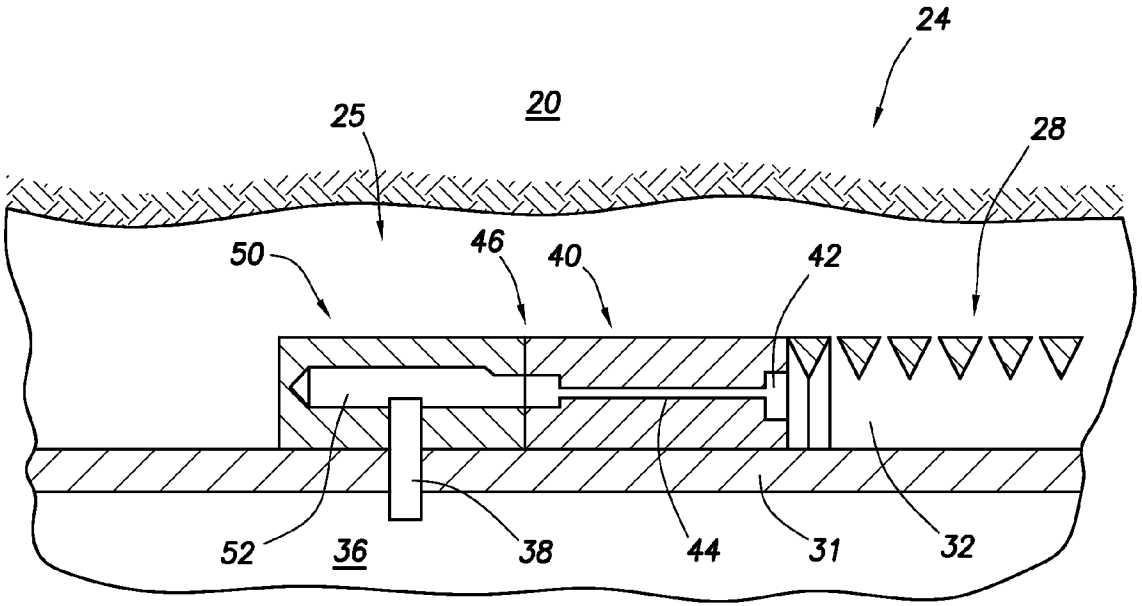
FIG. 2 is a side view in cross-section of a screen system and an embodiment of a flow control system of the invention.

FIG. 2 is a side view in cross-section of a screen system 28, and an embodiment of a flow control system 25 of the invention. The production tubular defines an interior screen annulus or passageway 32. Fluid flows from the formation 20 into the production tubing section 24 through screen system 28. The specifics of the screen system are not explained in detail here. Fluid, after being filtered by the screen system 28, flows into the interior passageway 32 of the production tubing section 24. As used here, the interior passageway 32 of the production tubing section 24 can be an annular space, as shown, a central cylindrical space, or other arrangement.

A port 42 provides fluid communication from the screen annulus 32 to a flow control system having a fluid passageway 44, a switch assembly 46, and an autonomous, variable flow resistance assembly 50, such as a vortex assembly. If the variable flow resistance assembly is an exemplary vortex assembly, it includes a vortex chamber 52 in fluid communication with an outlet passageway 38. The outlet passageway 38 directs fluid into a passageway 36 in the tubular for production uphole, in a preferred embodiment. The passageway 36 is defined in this embodiment by the tubular wall 31.

The methods and apparatus herein are intended to control fluid flow based on changes in a fluid characteristic over time. Such characteristics include viscosity, velocity, flow rate, and density. These characteristics are discussed in more detail in the references incorporated herein. The term "viscosity" as used herein means any of the rheological properties including kinematic viscosity, yield strength, viscoplasticity, surface tension, wettability, etc. As the proportional amounts of fluid components, for example, oil and natural gas, in the produced fluid change over time, the characteristic of the fluid flow also changes. When the fluid contains a relatively high proportion of natural gas, for example, the density and viscosity of the fluid will be less than for oil. The behavior of fluids is dependent on the characteristics of the fluid flow. Further, certain configurations of passageway will restrict flow, or provide greater resistance to flow, depending on the characteristics of the fluid flow.

Figure 3:
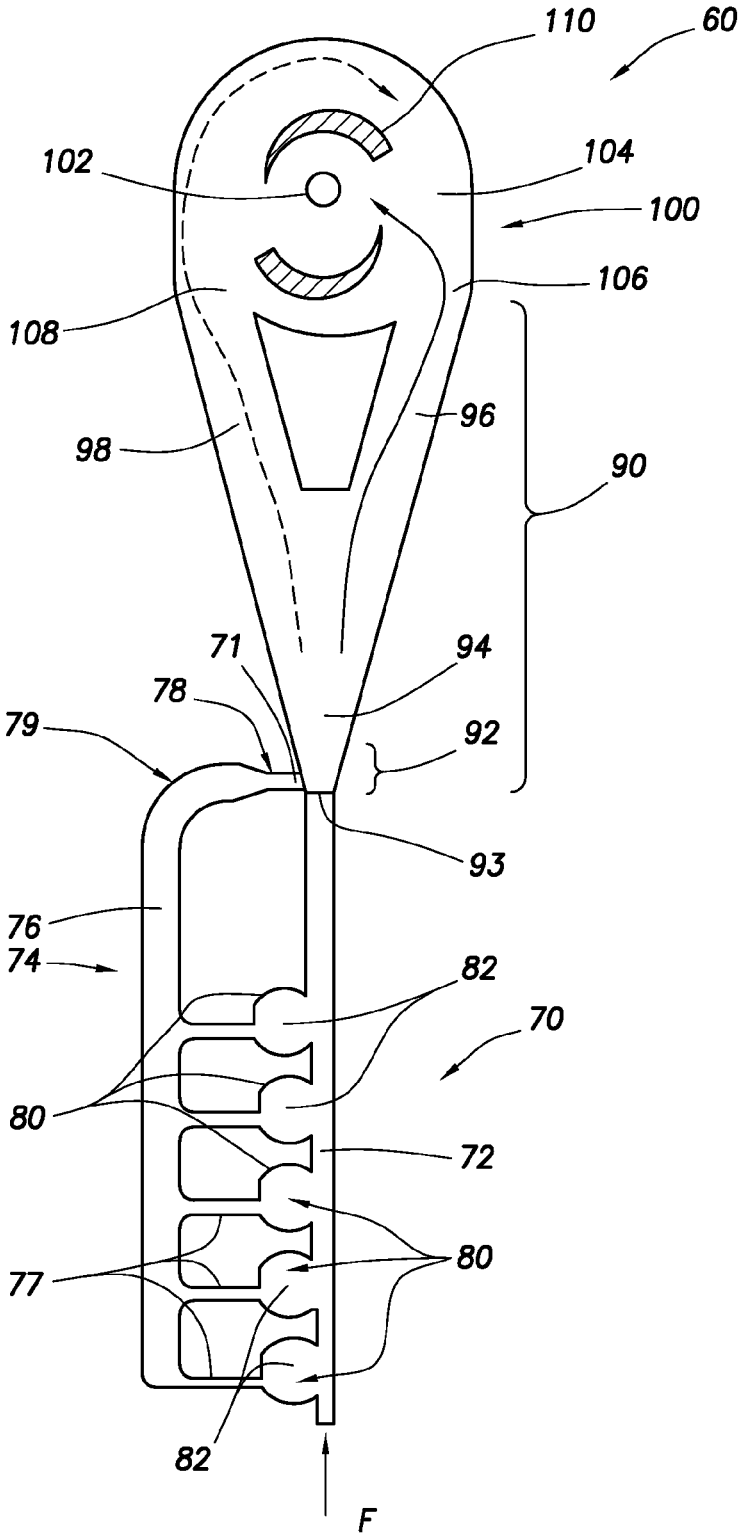
FIG. 3 is a schematic representational view of a prior art, "control jet" type, autonomous flow control system 60.

FIG. 3 is a schematic representational view of a prior art, "control jet" type autonomous flow control system 60. The control jet type system 60 includes a fluid selector assembly 70, a fluidic switch 90, and a variable flow resistance assembly, here a vortex assembly 100. The fluid selector assembly 70 has a primary fluid passageway 72 and a control jet assembly 74. An exemplary embodiment is shown; prior art systems are fully discussed in the references incorporated herein. An exemplary system will be discussed for comparison purposes.

The fluid selector assembly 70 has a primary fluid passageway 72 and a control jet assembly 74. The control jet assembly 74 has a single control jet passageway 76. Other embodiments may employ additional control jets. The fluid F enters the fluid selector assembly 70 at the primary passageway 72 and flows towards the fluidic switch 90. A portion of the fluid flow splits off from the primary passageway 72 to the control jet assembly 74. The control jet assembly 74 includes a control jet passageway 76 having at least one inlet 77 providing fluid communication to the primary passageway 72, and an outlet 78 providing fluid communication to the fluidic switch assembly 90. A nozzle 71 can be provided if desired to create a "jet" of fluid upon exit, but it not required. The outlet 78 is connected to the fluidic switch assembly 90 and directs fluid (or communicates hydrostatic pressure) to the fluidic switch assembly. The control jet outlet 78 and the downstream portion 79 of the control jet passageway 72 longitudinally overlap the lower portion 92 of the fluidic switch assembly 90, as shown.

The exemplary control jet assembly further includes a plurality of inlets 77, as shown. The inlets preferably include flow control features 80, such as the chambers 82 shown, for controlling the volume of fluid F which enters the control jet assembly from the primary passageway dependent on the characteristic of the fluid. That is, the fluid selector assembly 70 "selects" for fluid of a preferred characteristic. In the embodiment shown, where the fluid is of a relatively higher viscosity, such as oil, the fluid flows through the inlets 77 and the control passageway 76 relatively freely. The fluid exiting the downstream portion 79 of the control jet passageway 72 through nozzle 78, therefore, "pushes" the fluid flowing from the primary passageway after its entry into the fluidic switch 90 at mouth 94. The control jet effectively directs the fluid flow towards a selected side of the switch assembly. In this case, where the production of oil is desired, the control jet directs the fluid flow through the switch 90 along the "on" side. That is, fluid is directed through the switch towards the switch "on" passageway 96 which, in turn, directs the fluid into the vortex assembly to produce a relatively direct flow toward the vortex outlet 102, as indicated by the solid arrow.

A relatively less viscous fluid, such as water or natural gas, will behave differently. A relatively lower volume of fluid will enter the control jet assembly 74 through the inlets 77 and control features 80. The control features 80 are designed to produce a pressure drop which is communicated, through the control jet passageway 76, outlet 78 and nozzle 71, to the mouth 94 of the sticky switch. The pressure drop "pulls" the fluid flow from the primary passageway 72 once it enters the sticky switch mouth 94. The fluid is then directed in the opposite direction from the oil, toward the "off" passageway 98 of the switch and into the vortex assembly 100. In the vortex assembly, the less viscous fluid is directed into the vortex chamber 104 by switch passageway 98 to produce a relatively tangential spiraled flow, as indicated by the dashed arrow.

The fluidic switch assembly 90 extends from the downstream end of the primary passageway 72 to the inlets into the vortex assembly 60 (and does not include the vortex assembly). The fluid enters the fluidic switch from the primary passageway at inlet port 93, the defined dividing line between the primary passageway 72 and the fluidic switch 90. The fluidic switch overlaps longitudinally with the downstream portion 79 of the control jet passageway 76, including the outlet 78 and nozzle 71. The fluid from the primary passageway flows into the mouth 94 of the fluidic switch where it is joined and directed by fluid entering the mouth 94 from the control jet passageway 76. The fluid is directed towards one of the fluidic switch outlet passageways 96 and 98 depending on the characteristic of the fluid at the time. The "on" passageway 96 directs fluid into the vortex assembly to produce a relatively radial flow towards the vortex outlet and a relatively low pressure drop across the valve assembly. The "off" passageway 98 directs the fluid into the vortex assembly to produce a relatively spiraled flow, thereby inducing a relatively high pressure drop across the autonomous valve assembly. Fluid will often flow through both outlet passageways 96 and 98, as shown. Note that a fluidic switch and a sticky switch are distinct types of switch.

The vortex assembly 100 has inlet ports 106 and 108 corresponding to outlet passageways 96 and 98 of the sticky switch. The fluid behavior within the vortex chamber 104 has already been described. The fluid exits through the vortex outlet 102. Optional vanes or directional devices 110 may be employed as desired.

More complete descriptions of, and alternative designs for, the autonomous valve assembly employing control jets can be found in the references incorporated herein. For example, in some embodiments, the control jet assembly splits the flow into multiple control passageways, the ratio of the flow through the passageways dependent on the flow characteristic, passageway geometries, etc.

Figure 4A:
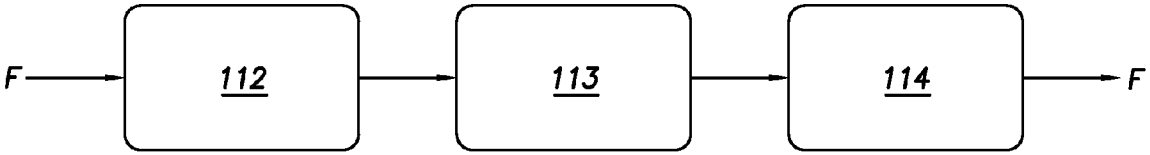
FIG. 4A-B are flow charts comparing the prior art, control-jet type of autonomous valve assembly and the sticky-switch type of autonomous valve assembly presented herein.
Figure 4B:
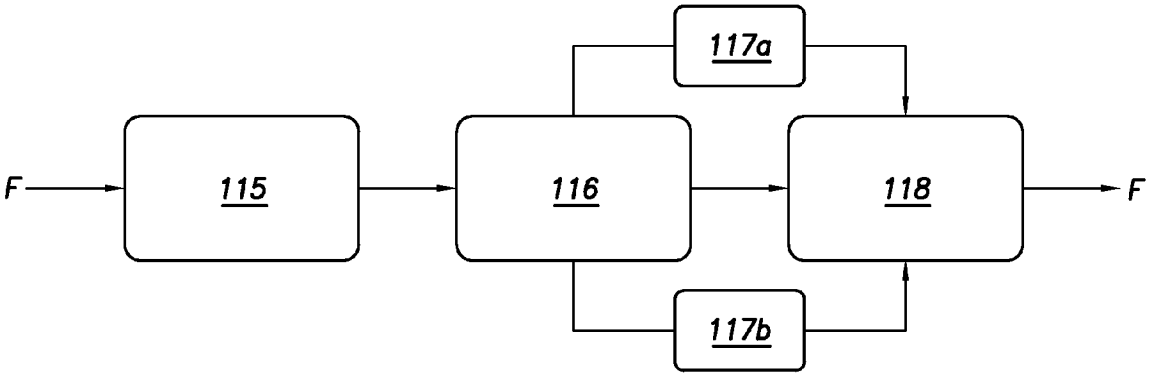

FIG. 4A-B are flow charts comparing the prior art, control-jet type of autonomous valve assembly and the sticky-switch type of autonomous valve assembly presented herein. The sticky switch type autonomous valve flow diagram at FIG. 4A begins with fluid, F, flowing through an inlet passageway at step 112, then through and affected by a biasing mechanism at step 113 which biases fluid flow into the sticky switch based on a characteristic of the fluid which changes over time. Fluid then flows into the sticky switch at step 114 where the fluid flow is directed towards a selected side of the switch (off or on, for example). No control jets are employed.

FIG. 4B is a flow diagram for a standard autonomous valve assembly. At step 115 the fluid, F, flows through inlet passageway, then into a fluid selector assembly at step 116. The fluid selector assembly selects whether the fluid will be produced or not based on a fluid characteristic which changes over time. Fluid flows through at least one control jet at steps 117*a* and 117*b* and then into a fluidic switch, such as a bistable switch, at step 118.

Figure 5:
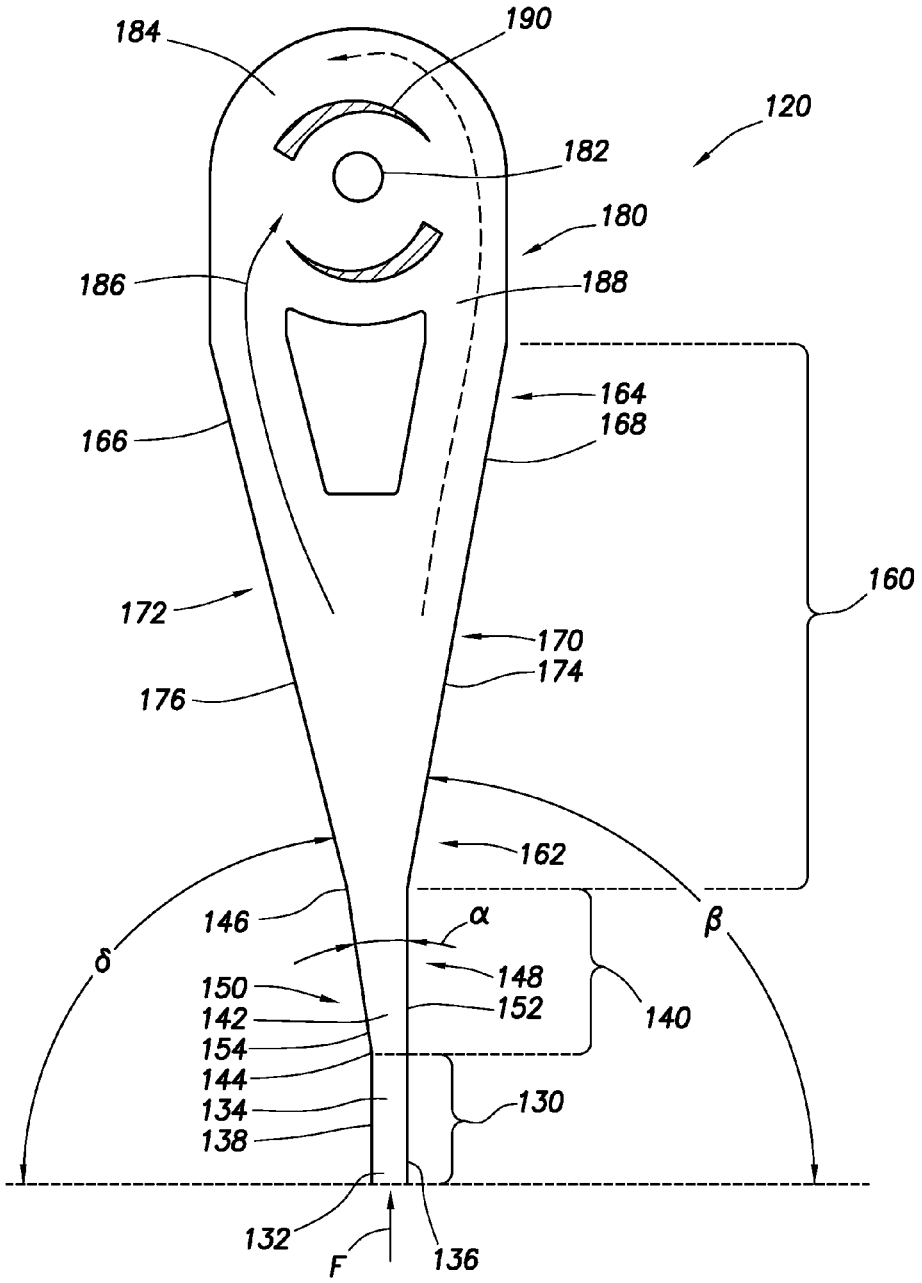
FIG. 5 is a schematic of a preferred embodiment of a sticky switch type autonomous valve according to an aspect of the invention.

FIG. 5 is a schematic of a preferred embodiment of a sticky switch type autonomous valve according to an aspect of the invention. The sticky switch type autonomous control valve 120 has an inlet passageway 130, a biasing mechanism 140, a sticky switch assembly 160, and a variable flow resistance assembly, here a vortex assembly 180.

The inlet passageway 130 communicates fluid from a source, such as formation fluid from a screen annulus, etc., to the biasing mechanism 140. Fluid flow and fluid velocity in the passageway is substantially symmetric. The inlet passageway extends as indicated and ends at the biasing mechanism. The inlet passageway has an upstream end 132 and a downstream end 134.

The biasing mechanism 140 is in fluid communication with the inlet passageway 130 and the sticky switch assembly 160. The biasing mechanism 140 may take various forms, as described herein.

The exemplary biasing mechanism 140 has a biasing mechanism passageway 141 which extends, as shown, from the downstream end of the inlet passageway to the upstream end of the sticky switch. In a preferred embodiment, the biasing mechanism 140 is defined by a widening passageway 142, as shown. The widening passageway 142 widens from a first cross-sectional area (for example, measured using the width and height of a rectangular cross-section where the inlet and widening passageways are rectangular tubular, or measured using a diameter where the inlet passageway and widening passageways are substantially cylindrical) at its upstream end 144, to a larger, second cross-sectional area at its downstream end 146. The discussion is in terms of rectangular cross-section passageways. The biasing mechanism widening passageway 142 can be thought of as having two longitudinally extending "sides," a first side 148 and a second side 150 defined by a first side wall 152 and a second side wall 154. The first side wall 152 is substantially coextensive with the corresponding first side wall 136 of the inlet passageway 130. The second side wall 154, however, diverges from the corresponding second side wall 138 of the inlet passageway, thereby widening the biasing mechanism from its first to its second cross-sectional areas. The walls of the inlet passageway are substantially parallel. In a preferred embodiment, the widening angle $\alpha$ between the first and second side walls 152 and 154 is approximately five degrees.

The sticky switch 160 communicates fluid from the biasing mechanism to the vortex assembly. The sticky switch has an upstream end 162 and a downstream end 164. The sticky switch defines an "on" and an "off" outlet passageways 166 and 168, respectively, at its downstream end. The outlet passageways are in fluid communication with the vortex assembly 180. As its name implies, the sticky switch directs the fluid flow toward a selected outlet passageway. The sticky switch can thought of as having first and second sides 170 and 172, respectively, corresponding to the first and second sides of the biasing mechanism. The first and second side walls 174 and 176, diverge from the first and second biasing mechanism walls, creating a widening cross-sectional area in the switch chamber 178. The departure angles $\beta$ and $\delta$ are defined, as shown, as the angle between the sticky switch wall and a line normal to the inlet passageway walls (and the first side wall of the biasing mechanism). The departure angle $\delta$ on the second side is shallower than the departure angle $\beta$ on the first side. For example, the departure angle $\beta$ can be approximately 80 degrees while the departure angle $\delta$ is approximately 75 degrees.

The vortex assembly 180 has inlet ports 186 and 188 corresponding to outlet passageways 166 and 168 of the sticky switch. The fluid behavior within a vortex chamber 184 has already been described. The fluid exits through the vortex outlet 182. Optional vanes or directional devices 190 may be employed as desired.

In use, a more viscous fluid, such as oil, "follows" the widening. Stated another way, the more viscous fluid tends to "stick" to the diverging (second) wall of the biasing mechanism in addition to sticking to the non-diverging (first) wall. That is, the fluid flow rate and/or fluid velocity distribution across the cross-section at the biasing mechanism downstream end 146 are relatively symmetrical from the first to the second sides. With the shallower departure angle $\delta$ upon exiting the biasing mechanism, the more viscous fluid follows, or sticks to, the second wall of the sticky switch. The switch, therefore, directs the fluid toward the selected switch outlet.

Conversely, a less viscous fluid, such as water or natural gas, does not tend to "follow" the diverging wall. Consequently, a relatively less symmetric flow distribution occurs at the biasing mechanism outlet. The flow distribution at a cross-section taken at the biasing mechanism downstream end is biased to guide the fluid flow towards the first side 170 of the sticky switch. As a result, the fluid flow is directed toward the first side of the sticky switch and to the "off" outlet passageway of the switch.

Figure 6A:
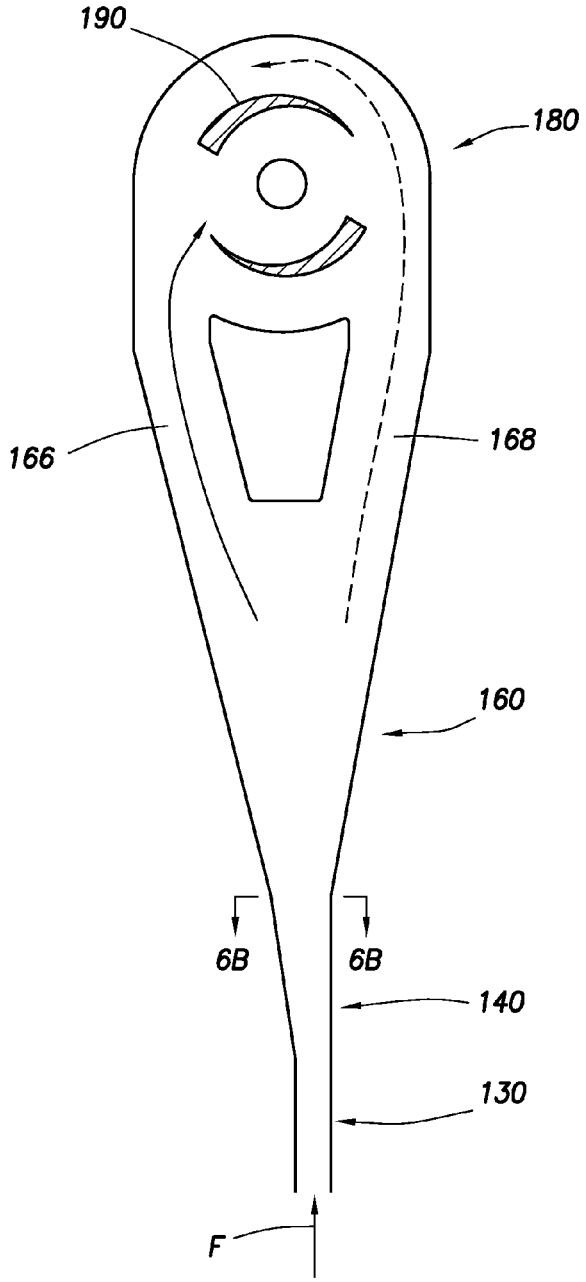
FIGS. 6A-B are graphical representations of a relatively more viscous fluid flowing through the exemplary assembly.
Figure 6B:
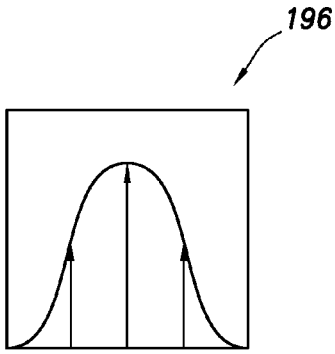

FIG. 6 is a graphical representation of a relatively more viscous fluid flowing through the exemplary assembly. Like parts are numbered and will not be discussed again. The more viscous fluid, such as oil, flows through the inlet passageway and into the biasing mechanism. The oil follows the diverging wall of the biasing mechanism, resulting in a relatively symmetrical flow distribution at the biasing mechanism downstream end. The detail shows a graphical representation of a velocity distribution 196 at the downstream end. The velocity curve is generally symmetric across the opening. Similar distributions are seen for flow rates, mass flow rates, etc.

Note a difference between the fluidic switch (as in FIG. 3) and the sticky switch of the invention. An asymmetric exit angle in the fluidic switch assembly directs the generally symmetric flow (of the fluid entering the fluidic switch) towards the selected outlet. The biasing mechanism in the sticky switch creates an asymmetric flow distribution at the exit of the biasing mechanism (and entry of the switch), which asymmetry directs the fluid towards the selected outlet. (Not all of the fluid will typically flow through a single outlet; it is to be understood that an outlet is selected with less than all of the fluid flowing therethrough.)

Figure 7A:
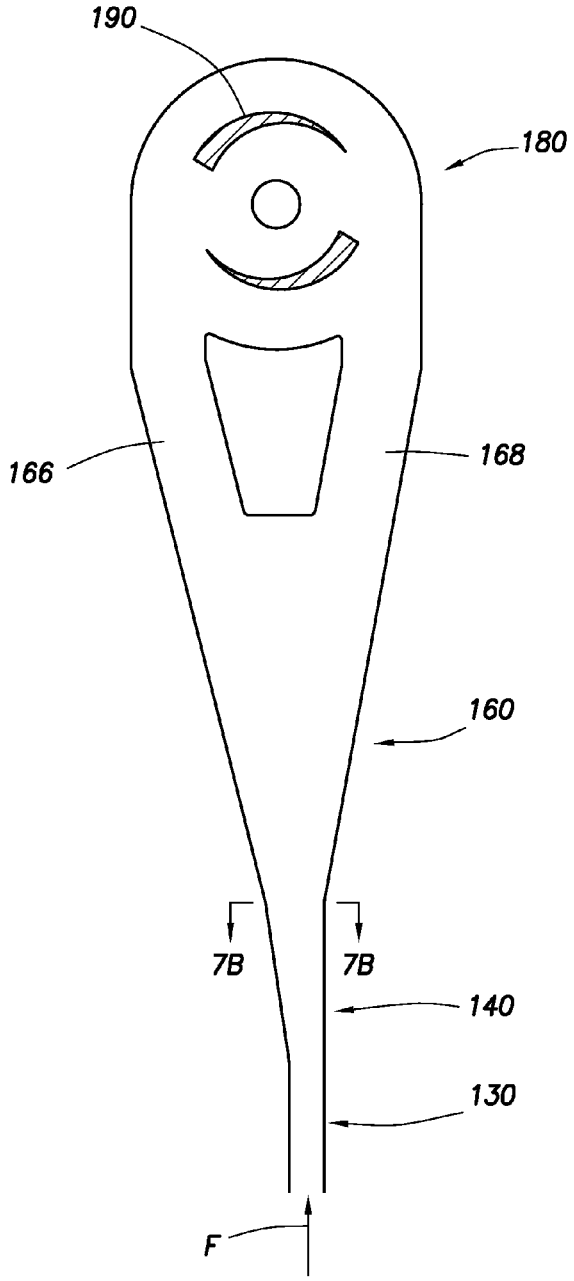
FIG. 7A-B are graphical representations of a relatively less viscous fluid flowing through the exemplary assembly.
Figure 7B:
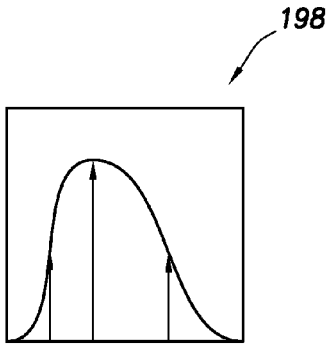

FIG. 7 is a graphical representation of a relatively less viscous fluid flowing through the exemplary assembly. Like parts are numbered and will not be discussed again. The less viscous fluid, such as water or natural gas, flows through the inlet passageway and into the biasing mechanism. The water fails to follow the diverging wall of the biasing mechanism (in comparison to the more viscous fluid), resulting in a relatively asymmetrical or biased flow distribution at the biasing mechanism downstream end. The detail shows a graphical representation of a velocity distribution 198 at the downstream end. The velocity curve is generally asymmetric across the opening.

The discussion above addresses viscosity as the fluid characteristic of concern, however, other characteristics may be selected such as flow rate, velocity, etc. Further, the configuration can be designed to "select" for relatively higher or lower viscosity fluid by reversing which side of the switch produces spiral flow, etc. These variations are discussed at length in the incorporated references.

Additional embodiments can be employed using various biasing mechanisms to direct fluid flow toward or away from a side of the sticky switch. The use of these variations will not be discussed in detail where their use is similar to that described above. Like numbers are used throughout where appropriate and may not be called out.

Figure 8:
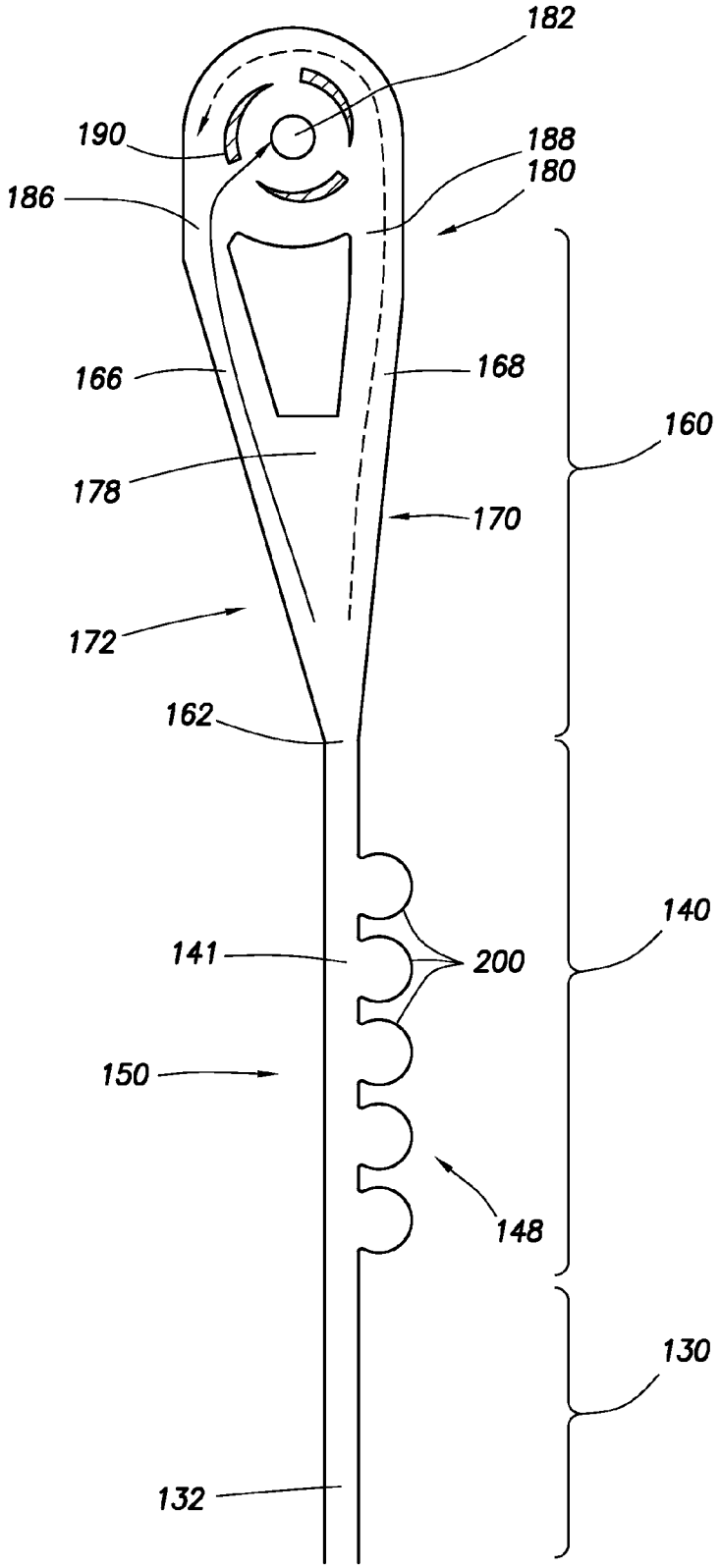
FIG. 8 is a schematic view of an alternate embodiment of the invention having a biasing mechanism employing wall contour elements.

FIG. 8 is a schematic view of an alternate embodiment of the invention having a biasing mechanism employing wall contour elements. The inlet passageway 130 directs fluid into the biasing mechanism 140. The second side 150 of the biasing mechanism is relatively smooth in contour. The first side 148 of the biasing mechanism passageway has one or more contour elements 200 are provided in the first side wall 152 of the biasing mechanism. Here, the contour elements are circular hollows extending laterally from the biasing mechanism passageway. As the fluid, F, flows along the biasing mechanism, the contour elements 200 shift the centerline of the flow and alter the fluid distribution in the biasing mechanism. (The distributions may or may not be symmetrical.) In a manner analogous to refraction of light, the contours seem to add resistance to the fluid and to refract the fluid flow. This fluid refraction creates a bias used by the switch to control the direction of the fluid flow. As a result, a more viscous fluid, such as oil, flows in the direction of the second side 172 of the sticky switch, as indicated by the solid arrow. A relatively less viscous fluid, such as water or natural gas, is directed the other direction, toward the first side 170 of the sticky switch, as indicated by the dashed line.

It will be obvious to those skilled in the art that other curved, linear, or curvilinear contour elements could be used, such as triangular cuts, saw-tooth cuts, Tesla fluidic diodes, sinusoidal contours, ramps, etc.

Figure 9:
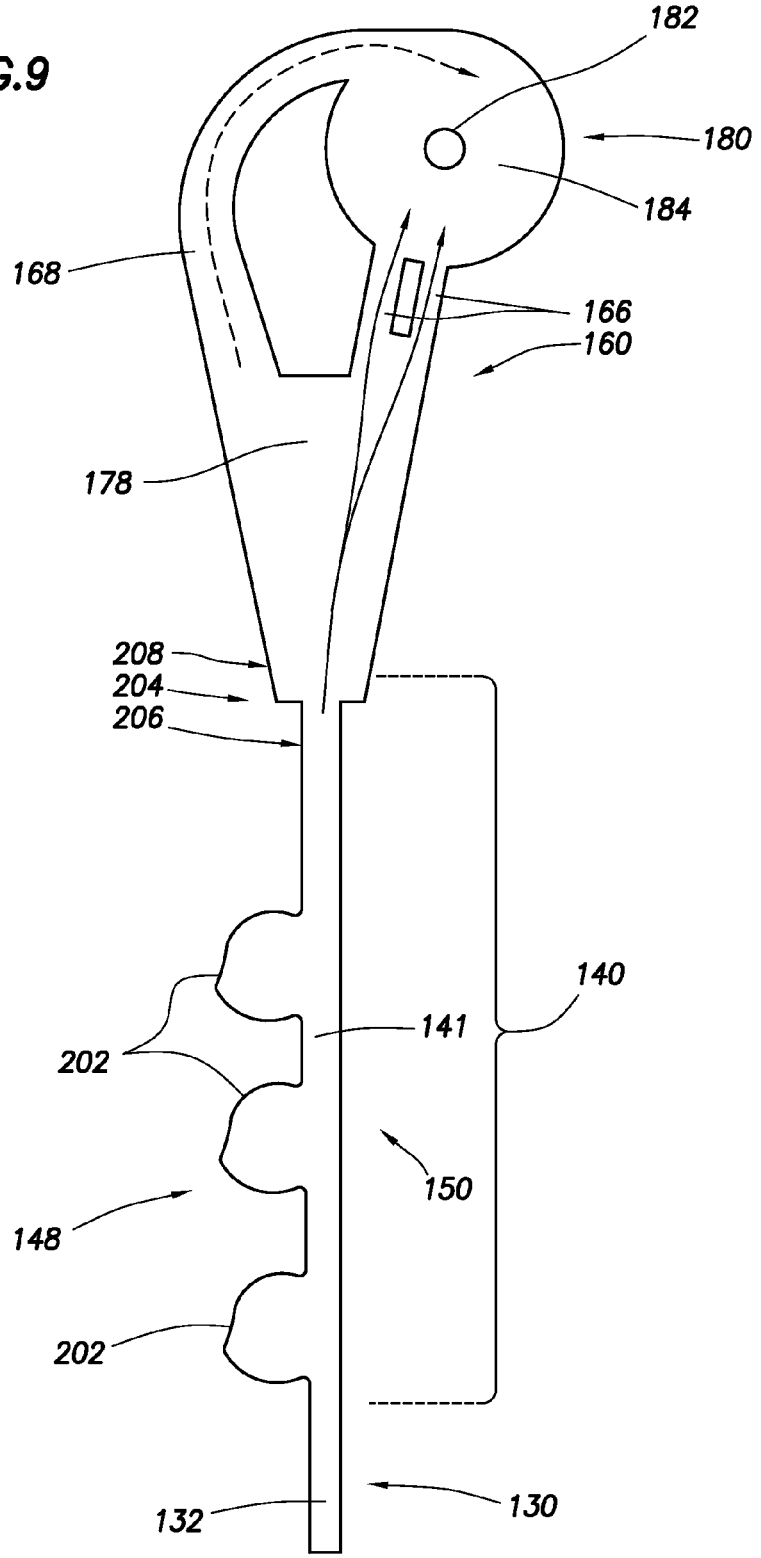
FIG. 9 is a detail schematic view of an alternate embodiment of the invention having a biasing element including contour elements and a stepped cross-sectional passageway shape.

FIG. 9 is a detail schematic view of an alternate embodiment of the invention having a biasing element including contour elements and a stepped cross-sectional passageway shape. The biasing mechanism 140 has a plurality of contour elements 202 along one side of the biasing mechanism passageway 141. The contour elements 202 here are differently sized, curved cut-outs or hollows extending laterally from the biasing mechanism passageway 141. The contour elements affect fluid distribution in the passageway.

Also shown is another type of biasing mechanism, a step-out 204, or abrupt change in passageway cross-section. The biasing mechanism passageway 141 has a first cross-section 206 along the upstream portion of the passageway. At a point downstream, the cross-section abruptly changes to a second cross-section 208. This abrupt change alters the fluid distribution at the biasing mechanism downstream end. The cross-sectional changes can be used alone or in combination with additional elements (as shown), and can be positioned before or after such elements. Further, the cross-section change can be from larger to smaller, and can change in shape, for example, from circular to square, etc.

The biasing mechanism causes the fluid to flow towards one side of the sticky switch for a more viscous fluid and toward the other side for a less viscous fluid.

FIG. 9 also shows an alternate embodiment for the sticky switch outlet passageways 166 and 168. Here a plurality of "on" outlet passageways 166 direct fluid from the sticky switch to the vortex assembly 180. The fluid is directed substantially radially into the vortex chamber 184 resulting in more direct flow to the vortex outlet 182 and a consequent lower pressure drop across the device. The "off" outlet passageway 168 of the sticky switch directs fluid into the vortex chamber 184 substantially tangentially resulting in a spiral flow in the chamber and a relatively greater pressure drop across the device than would otherwise be created.

Figure 10:
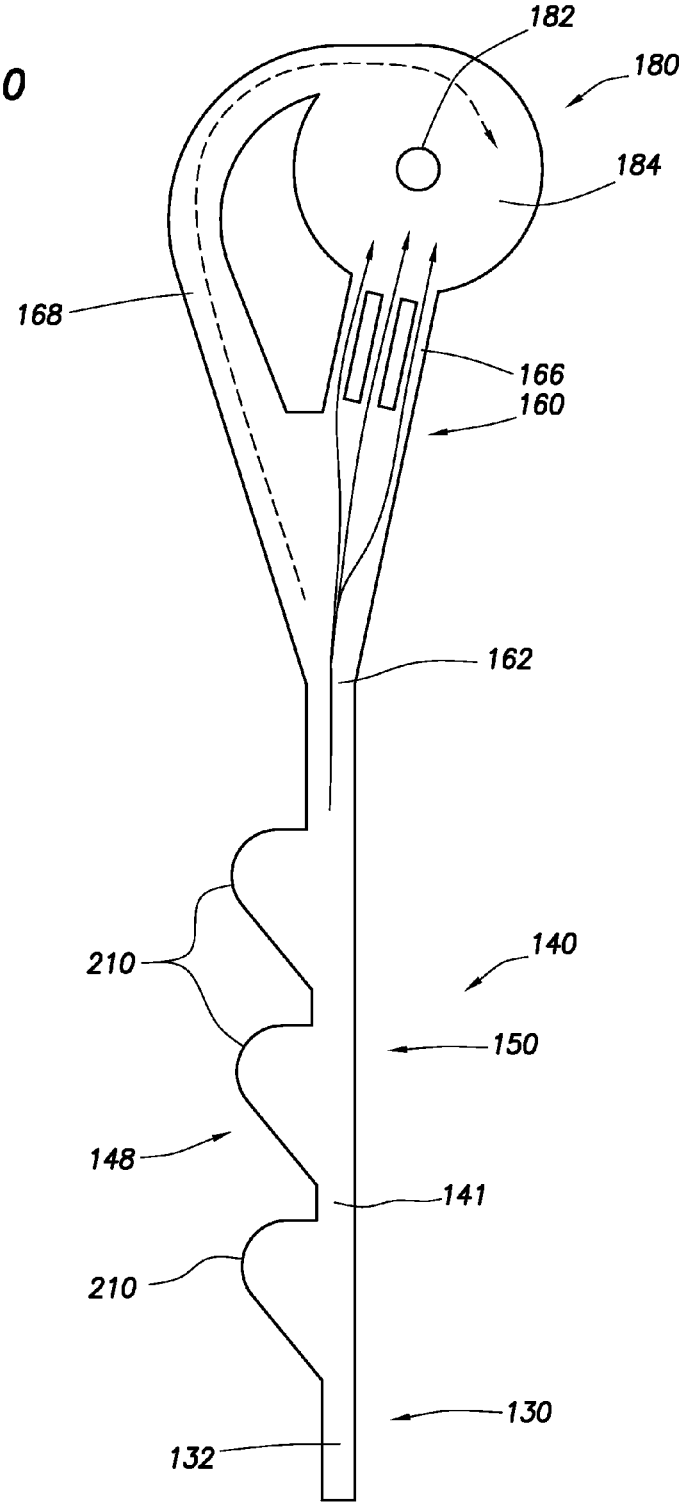
FIG. 10 is a schematic view of an alternate embodiment of the invention having fluidic diode shaped cut-outs as contour elements in the biasing mechanism.

FIG. 10 is a schematic view of an alternate embodiment of the invention having fluidic diode shaped cut-outs as contour elements in the biasing mechanism. The biasing mechanism 140 has one or more fluidic diode-shaped contour elements 210 along one side wall which affect the flow distribution in the biasing mechanism passageway 141 and at its downstream end. The flow distribution, which changes in response to changes in the fluid characteristic, directs the fluid toward selected sides of the sticky switch.

Figure 11:
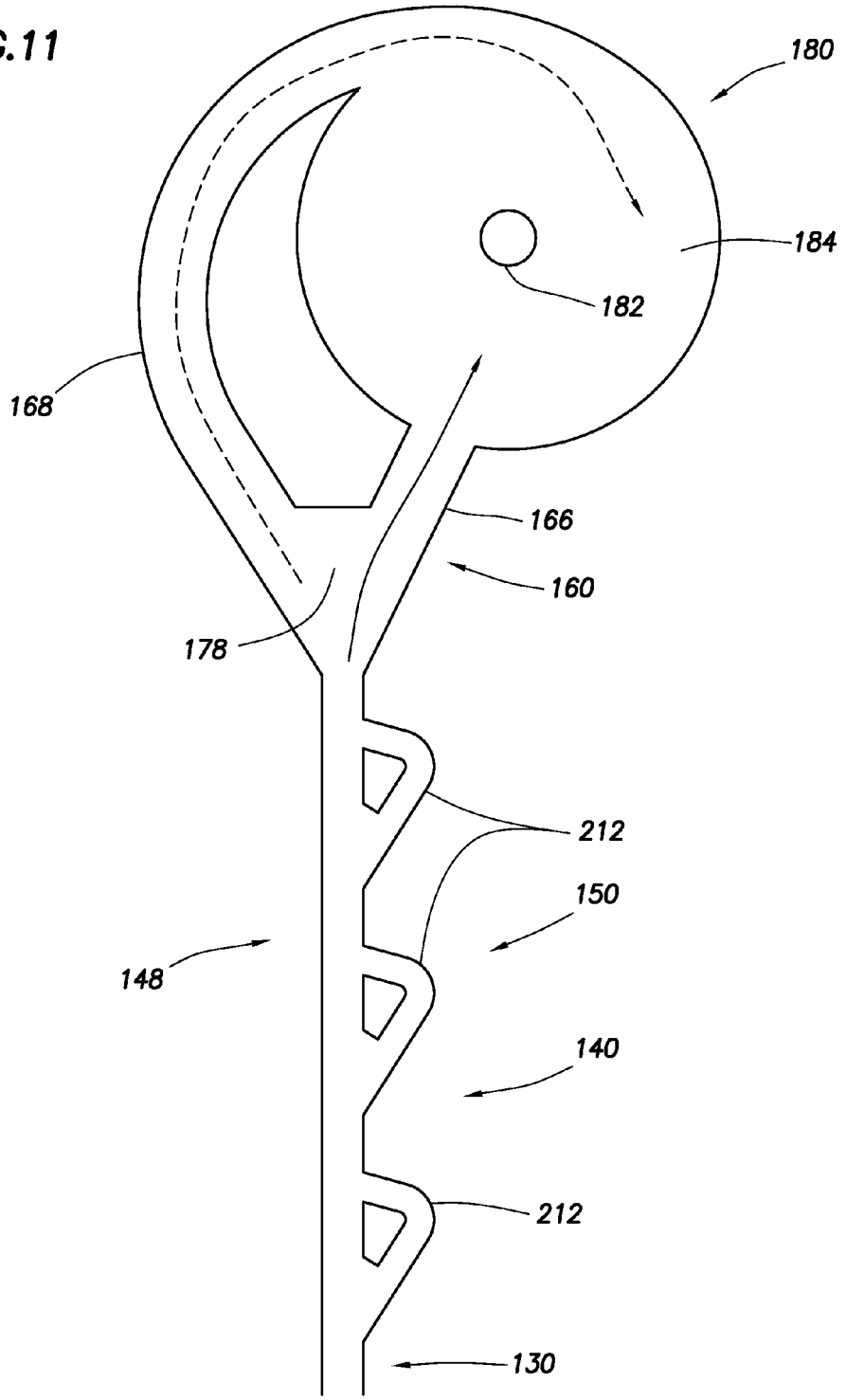
FIG. 11 is a schematic view of an alternate embodiment of the invention having Tesla diodes along the first side of the fluid passageway.

FIG. 11 is a schematic view of an alternate embodiment of the invention having Tesla diodes 212 along the first side 148 of the fluid passageway 141. The Tesla diodes affect the flow distribution in the biasing mechanism. The flow distribution changes in response to changes in the fluid characteristic, thereby directing the fluid toward selected sides of the sticky switch.

Figure 12:
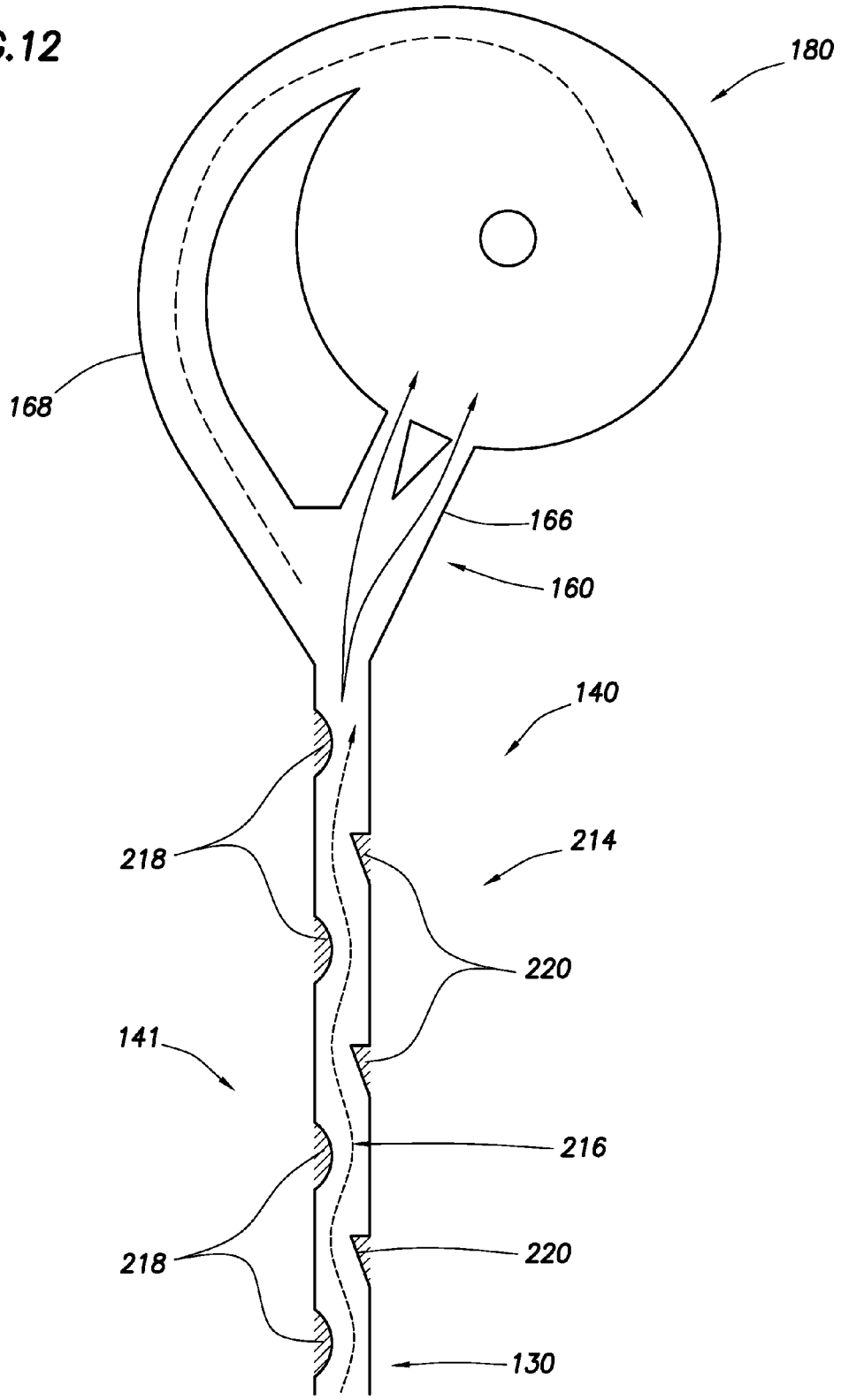
FIG. 12 is a schematic view of an alternate embodiment of the invention having a chicane 214, or a section of the biasing mechanism passageway 141 having a plurality of bends 216 created by flow obstacles 218 and 220 positioned along the sides of the passageway.

FIG. 12 is a schematic view of an alternate embodiment of the invention having a chicane 214, or a section of the biasing mechanism passageway 141 having a plurality of bends 216 created by flow obstacles 218 and 220 positioned along the sides of the passageway. The chicane affects the flow distribution in the biasing mechanism. The flow distribution changes in response to changes in the fluid characteristic, thereby directing the fluid toward selected sides of the sticky switch. In the exemplary embodiment shown, the flow obstacles 218 along the opposite side are semi-circular in shape while the flow obstacles 220 are substantially triangular or ramp-shaped. Other shapes, numbers, sizes and positions can be used for the chicane elements.

Figure 13:
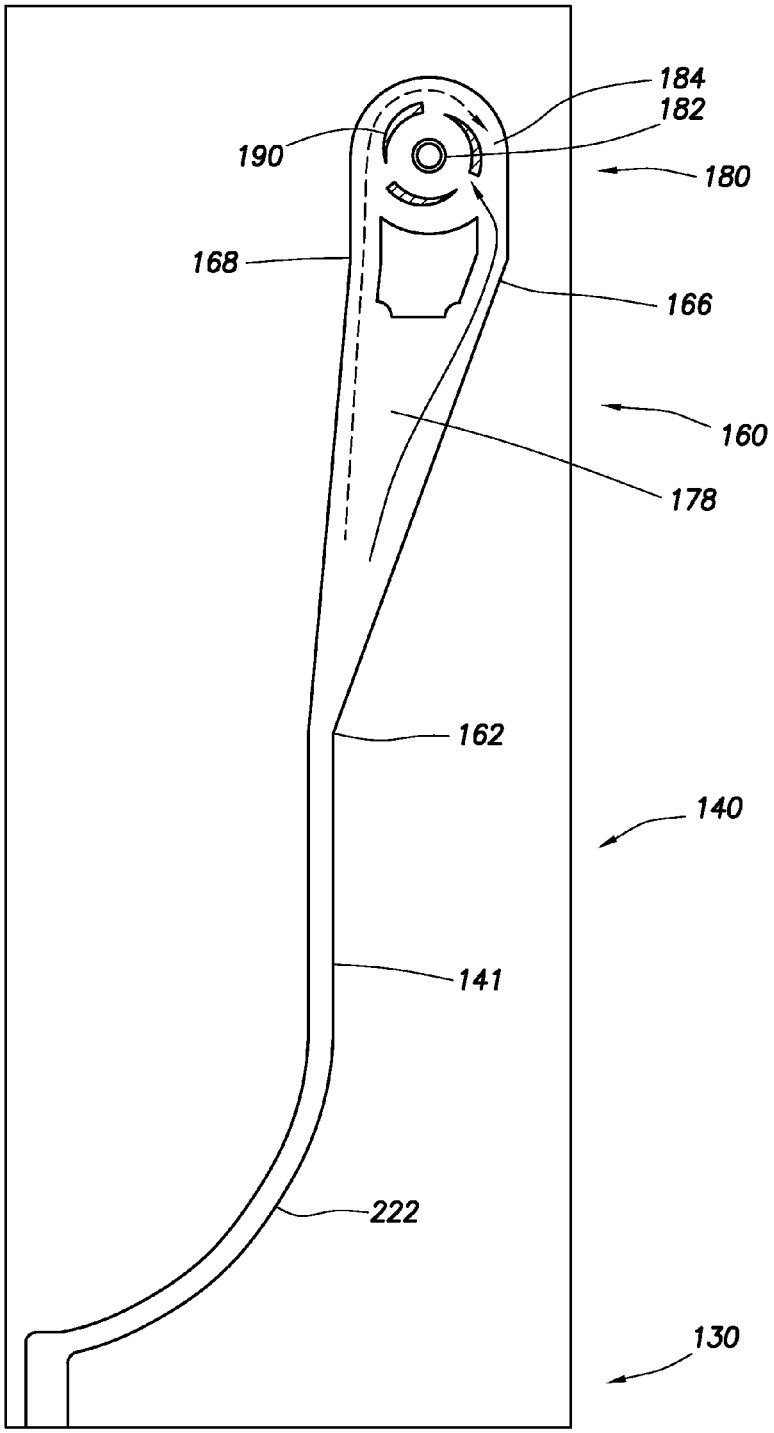
FIG. 13 is a schematic view of an alternate embodiment of the invention having a biasing mechanism passageway with a curved section.

FIG. 13 is a schematic view of an alternate embodiment of the invention having a biasing mechanism passageway 141 with a curved section 222. The curved section operates to accelerate the fluid along the concave side of the passageway. The curved section affects flow distribution in the biasing mechanism. The flow distribution changes in response to changes in the fluid characteristic, thereby directing the fluid toward selected sides of the sticky switch. Other and multiple curved sections can be employed.

The invention can also be used with other flow control systems, such as inflow control devices, sliding sleeves, and other flow control devices that are already well known in the industry. The inventive system can be either parallel with or in series with these other flow control systems.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

Further, the invention can be used to select for more viscous fluids over less viscous fluids or vice versa. For example, it may be desirable to produce natural gas but restrict production of water, etc. The following U.S. Patents and Applications for patent, referenced by Patent Number or Patent Application Serial Numbers, are each hereby incorporated herein by reference for all purposes, including providing support for any claimed subject matter: U.S. patent application Ser. No. 12/700,685, Method and Apparatus for Autonomous Downhole Fluid Selection with Pathway Dependent Resistance System; Ser. No. 12/750,476, Tubular Embedded Nozzle Assembly for Controlling the Flow Rate of Fluids Downhole; Ser. No. 12/791,993, Flow Path Control Based on Fluid Characteristics to Thereby Variably Resist Flow in a Subterranean Well; Ser. No. 12/792,095, Alternating Flow Resistance Increases and Decreases for Propagating Pressure Pulses in a Subterranean Well; Ser. No. 12/792,117, Variable Flow Resistance System for Use in a Subterranean Well; Ser. No. 12/792,146, Variable Flow Resistance System With Circulation Inducing Structure Therein to Variably Resist Flow in a Subterranean Well; Ser. No. 12/879,846, Series Configured Variable Flow Restrictors For Use In A Subterranean Well; Ser. No. 12/869,836, Variable Flow Restrictor For Use In A Subterranean Well; Ser. No. 12/958,625, A Device For Directing The Flow Of A Fluid Using A Pressure Switch; Ser. No. 12/974,212, An Exit Assembly With a Fluid Director for Inducing and Impeding Rotational Flow of a Fluid; and Ser. No. 12/966,772, Downhole Fluid Flow Control System and Method Having Direction Dependent Flow Resistance. Each of the incorporated references described further details concerning methods and apparatus for autonomous fluid control.

It is claimed:

1. A method for autonomously controlling flow of a fluid in a wellbore extending through a subterranean formation, the fluid having a characteristic which autonomously changes over time, the fluid flowing through an inlet passageway, a flow biasing mechanism defining a widening passageway narrower at the upstream end and wider at the downstream end, wherein the downstream end of the biasing mechanism defines two sides which connect to corresponding first and second sides of a fluidic switch assembly, corresponding first and second departure angles defined at the connections, and, wherein the first departure angle is shallower than the second departure angle, and a variable flow resistance assembly, the method comprising the following steps:

communicating the fluid between the wellbore and the subterranean formation by flowing the fluid out of the subterranean formation and into the wellbore, or out of the wellbore and into the subterranean formation;

flowing the fluid through the inlet passageway;

resisting flow of the fluid with at least first and second walls of the flow biasing mechanism having dissimilar predefined shapes such that resistance to the dissimilar predefined shapes of the first and second walls establishes a first fluid flow distribution across an outlet of the flow biasing mechanism; then autonomously altering the first fluid flow distribution to a second flow distribution across the outlet of the flow biasing mechanism in response to an autonomous change in the fluid characteristic and in response to an associated change in the resistance to the dissimilar predefined shapes of the first and second walls of the flow biasing mechanism; and changing the fluid flow resistance of the variable flow resistance assembly in response to the altering of the distribution of flow from the outlet of the flow biasing mechanism.

2. A method as in claim 1, wherein the step of communicating the fluid between the wellbore and the subterranean formation comprises producing a production fluid from the subterranean formation into a first production interval defined in the wellbore, and wherein the method further comprises the step of flowing the production fluid to the surface.

3. A method as in claim 2, further comprising the step of increasing the fluid flow resistance of an undesirable component of the production fluid in the first production interval.

4. A method as in claim 3, further comprising flowing the production fluid from the subterranean formation into a second production interval defined in the wellbore that is fluidly isolated from the first production interval, wherein the production fluid flowing into the second production interval has a lower proportion of the undesirable component than the proportion of the undesirable component of the production fluid flowing into the first production interval.

5. A method as in claim 1, further comprising the steps of establishing a first flow pattern in the variable flow resistance assembly, and then changing the flow in the variable flow resistance assembly to a second flow pattern in response to the altering of the fluid flow through the outlet of the flow biasing mechanism.

6. A method as in claim 1, wherein the characteristic of the fluid is one of fluid velocity, density, flow rate, and velocity.

7. A method as in claim 1, wherein the first fluid flow distribution is substantially symmetric.

8. A method as in claim 1, wherein the variable flow resistance assembly includes an autonomous valve assembly.

9. A method as in claim 8, wherein the autonomous valve assembly further includes a vortex assembly.

10. A method as in claim 1, further comprising the step of flowing fluid through the fluidic switch between the biasing mechanism and the variable flow resistance assembly.

11. A method as in claim 10, the fluidic switch defining at least one flow passageway having an inlet coincident with an outlet of the inlet passageway.

12. A method as in claim 1, wherein the first and second fluid flow distributions include at least one of a velocity distribution, a flow rate distribution and a mass flow rate distribution.

13. A method as in claim 12, wherein one of the first fluid flow distribution and the second fluid flow distribution is relatively less symmetric between the first and second walls of the flow biasing mechanism than the other of the first fluid flow distribution and the second fluid flow distribution.

14. A method as in claim 1, wherein the upstream end of the flow biasing mechanism is coupled to an inlet passageway, and wherein the first wall of the flow biasing mechanism extends from the inlet passageway at a dissimilar angle from an angle at which the second wall of the flow biasing mechanism extends from the inlet passageway to the downstream end of the flow biasing mechanism.

15. A method as in claim 14 wherein the first sidewall of the flow biasing mechanism is substantially coextensive with a first sidewall of the inlet passageway, and wherein the second sidewall of the biasing mechanism diverges from a second sidewall of the inlet passageway thereby defining the widening passageway of the flow biasing mechanism.

* * * * *